US007081290B2

(12) United States Patent
Takahashi et al.

(10) Patent No.: US 7,081,290 B2
(45) Date of Patent: Jul. 25, 2006

(54) QUARTZ GLASS THERMAL SPRAYED PARTS AND METHOD FOR PRODUCING THE SAME

(75) Inventors: Koyata Takahashi, Sagamihara (JP); Masanori Kohgo, Fujisawa (JP)

(73) Assignee: Tosoh Corporation, Yamaguchi (JP)

( * ) Notice: Subject to any disclaimer, the term of this patent is extended or adjusted under 35 U.S.C. 154(b) by 379 days.

(21) Appl. No.: 10/405,226

(22) Filed: Apr. 3, 2003

(65) Prior Publication Data

US 2004/0018361 A1 Jan. 29, 2004

(30) Foreign Application Priority Data

| | | |
|---|---|---|
| Apr. 4, 2002 | (JP) | P. 2002-102656 |
| Aug. 1, 2002 | (JP) | P. 2002-225103 |
| Aug. 30, 2002 | (JP) | P. 2002-254686 |
| Oct. 1, 2002 | (JP) | P. 2002-288946 |
| Oct. 24, 2002 | (JP) | P. 2002-310241 |

(51) Int. Cl.
*B23B 3/00* (2006.01)

(52) U.S. Cl. ..... 428/156; 428/174; 428/212; 428/304.4; 428/432; 428/446; 428/457; 428/469; 428/697; 428/699; 428/702; 428/703; 428/210; 428/209

(58) Field of Classification Search ..... 428/156, 428/174, 212, 304.4, 426, 428, 432, 433, 428/446, 457, 469, 697, 699, 702, 703, 210, 428/209

See application file for complete search history.

(56) References Cited

U.S. PATENT DOCUMENTS

| | | | | |
|---|---|---|---|---|
| 5,460,689 | A | 10/1995 | Nulman et al. | |
| 6,306,489 | B1 * | 10/2001 | Hellmann et al. | 428/312.6 |
| 6,548,131 | B1 * | 4/2003 | Fabian et al. | 428/34.4 |

FOREIGN PATENT DOCUMENTS

| | | | |
|---|---|---|---|
| EP | 1 281 689 | A2 | 2/2003 |
| GB | 1 547 530 | | 6/1979 |
| JP | 54-157121 | A | 12/1979 |
| JP | 60-120515 | A | 6/1985 |
| JP | 1-431164 | Y2 | 12/1989 |
| JP | 4-268065 | A | 9/1992 |
| JP | 5-262535 | A | 10/1993 |
| JP | 5-306142 | A | 11/1993 |
| JP | 06-051169 | * | 2/1994 |
| JP | 6-112133 | A | 4/1994 |
| JP | 07-196335 | * | 8/1995 |
| JP | 7-300327 | | 11/1995 |
| JP | 7-300327 | A | 11/1995 |

(Continued)

*Primary Examiner*—Jennifer McNeil
*Assistant Examiner*—G. Blackwell
(74) *Attorney, Agent, or Firm*—Sughrue Mion, PLLC

(57) ABSTRACT

Parts, especially those formed of quartz glass, for film-forming devices, plasma-treating devices and the like have a problem of inner pollution of the devices with particles given by dropping of deposit films from the parts, a problem of hermetical sealing reduction due to bonding failure of the parts to other parts, and a problem of energy efficiency reduction due to the heat insulation failure in the parts. Parts having a thermal sprayed quartz glass film formed on a substrate have an increased ability to hold a deposit thereon, and have an increased ability to hermetically bond to other parts. The parts having a thermal sprayed black quartz glass film have an increased ability of heat insulation property. Even when washed with acid, the abilities of the parts do not lower. The parts can be used for a long period of time and their life is long.

5 Claims, 6 Drawing Sheets

FOREIGN PATENT DOCUMENTS

| | | | |
|---|---|---|---|
| JP | 8-339895 | A | 12/1996 |
| JP | 9-506324 | A | 6/1997 |
| JP | 10-59744 | A | 3/1998 |
| JP | 11-106225 | A | 4/1999 |
| JP | 2000-256037 | A | 9/2000 |
| JP | 3114835 | B2 | 9/2000 |
| JP | 2001-226773 | A | 8/2001 |
| JP | 2002-75901 | A | 3/2002 |

* cited by examiner

QUARTZ GLASS THERMAL SPRAYED PARTS AND METHOD FOR PRODUCING THE SAME

FIELD OF THE INVENTION

The present invention relates to parts used in production devices for semiconductors and the like, and in particular to parts that give little dust and few particles to be caused by peeling of film-like materials having been deposited thereon or by deterioration of the parts themselves by plasma, parts having good adhesiveness in the bonding area to other parts, and parts having good heat insulation and durability.

The parts of the invention are produced by thermal spraying quartz glass on a substrate, and the substrate mainly comprises quartz glass, and may comprise metals or ceramics. The quartz glass thermal sprayed parts of the invention have a quartz glass thermal sprayed film excellent as a protective film or a barrier film, and hence are suitable as parts used in oxidative diffusion treatment devices, CVD film-forming devices, plasma treatment devices (plasma etching devices, plasma cleaning devices), lamp annealing devices and the like, that are used in producing semiconductors, etc.

DESCRIPTION OF THE RELATED ART

In forming a film of polysilicon, silicon nitride, silicon oxide or the like on a film substrate in the production of semiconductors and others, the problem often occurred that the film deposits on not only the film substrate but also the machine parts such as reactor tubes, bell jars, etc. The deposited film on the machine parts increases its thickness through repetition of the film-forming operation, thereby the parts crack due to the difference in thermal expansion between the deposited film and the parts, or the deposited film may peel away from the parts to pollute the area inside the machine.

One general method heretofore employed in the art for removing the deposited film from the parts comprises periodically cleaning the parts with an acid including hydrofluoric acid. However, in case where the deposited film is difficult to remove through treatment with hydrofluoric acid and when the parts are readily corroded with hydrofluoric acid (e.g., quartz glass parts), the method is the problem that the parts themselves are further corroded on the area thereof in which the deposited film is partially lost through washing with hydrofluoric acid, and as a result, the parts further deteriorate.

Some methods have heretofore been proposed for preventing the deposited film from peeling away from the parts. For example, the structure of the film-forming device is modified as disclosed in, for example, U.S. Pat. No. 5,460,689; the parts of the film-forming device are plasma spray coated with a metal or metal carbide of Mo, W, Al or WC as disclosed in, for example, JP-A-60-120515; or the parts are spray coated with metal aluminum as disclosed in, for example, JP-A-4-268065. A method is also proposed, in which an insulating film that is more anticorrosive to plasma than quartz is applied to a surface of a quartz part, for example, an alumina-based ceramic film is formed through explosive thermal spraying, as disclosed in, for example, JP-A-8-339895.

However, the parts with a film of Mo, W, Al, WC, alumina or the like formed on a substrate still have the problem that the film itself readily peels off. In addition, in the technical field in which quartz is used for the substrate, the coating composition for the film is unfavorable as causing impurities, and therefore it has been often reluctant to use those films.

For decreasing the peeling of the deposited film from the parts, quartz glass parts, the surface of which is roughened through blasting and/or acid etching, are also proposed as disclosed in, for example, JP-A-10-59744 and 11-106225.

However, the quartz glass parts processed through blasting have mircocracks on the roughened surfaces thereof, and the fragments of the parts that start from the microcracks thereof become impurities in devices. Another problem in the parts is that their life is short since their mechanical strength is low, and impurities readily penetrate into the microcracks to devitrify the parts. The problem of fragmentation to give impurities could not still be solved even though blasting is combined with acid etching for processing the parts. Moreover, while the quartz glass parts that have been surface-roughened through blasting are repeatedly washed with nitric acid/hydrofluoric acid, dimples in their surfaces come to gently slope and have an enlarged diameter, and as a result, their ability to hold the deposited film thereon lowers. Therefore, repeatedly washing the parts has the problem that their ability to hold the deposited film thereon lowers.

In case where the surfaces of quartz glass parts are roughened through chemical treatment alone, microcracks are difficult to be formed therein and the parts can maintain their original mechanical strength. However, the parts of this type have the problem that their surfaces are liable to be smoothed through acid washing and their ability to hold the deposit thereon readily lowers.

In case where quartz glass is used for parts (e.g., core tubes) of thermal treatment devices, there is the problem that the thermal energy inside the devices may leak out to lower the thermal efficiency of the devices since quartz glass is highly transparent. To solve the problem, it is considered to use opaque quartz glass with bubbles therein. However, such still has the problem that its adhesiveness (sealability) to other parts in their bonding area is not good since the bubbles may be exposed out on the surface of opaque quartz glass to worsen the surface smoothness of the glass.

In many of oxidative diffusion treatment devices, CVD (chemical vapor deposition) devices and others used for semiconductor production, a film substrate such as silicon wafer to be coated with a film is generally heated in a chamber, a bell jar or the like cell. In case where the chamber or the bell jar is formed of a material of mainly quartz glass, its flange or heat insulator is generally formed of porous opaque quartz glass of low thermal conductivity in order that the sealed end part thereof is not thermally deteriorated by the radiation heat generated in the cell. However, the porous opaque quartz glass has the problem that the sealability of the flange formed of it is not good since the bubbles may be exposed out on the surface of the glass. Another problem is that when the parts formed of porous opaque quartz glass are washed with nitric acid/hydrofluoric acid or the like after use, their surface smoothness is greatly lowered and they soon become useless.

Given that situation, quartz glass parts fabricated by welding transparent quartz glass to their flanges formed of opaque quartz glass have been proposed as disclosed in, for example, JP-UM-B-1-43164. However, the parts thus fabricated by welding a transparent glass sheet to their flanges formed of opaque quartz glass still have the problem that they are readily cracked and, in addition, the welded part is readily cleaved. In addition, the welding operation requires some technical skill and is therefore unsuitable to industrial use.

Another method has been proposed for forming a smooth surface-having seal part around the flange formed of opaque quartz glass, and it comprises heating all the opaque quartz glass substrate at 1,900° C. or higher, thermal spraying quartz glass powder on the thus-heated substrate, and further heating the substrate with oxyhydrogen flame (this is generally referred to as a Verneuil's method) to thereby form a layer of transparent quartz glass on the opaque quartz glass substrate, as disclosed in, for example, JP-A-7-300327. However, this still has the problem that the transparent quartz glass layer formed on the opaque quartz glass substrate is readily cracked and quartz glass parts having a complicated shape could not be fabricated. Another problem is that, in the Verneuil's method, since the substrate is maintained at high temperature of 1,900° C. or higher for a long period of time, impurities may diffuse out of the substrate even when the substrate is formed of synthetic quartz glass of high purity, and the purity of the surface of the parts fabricated is thereby lowered.

A casting process of producing quartz glass parts having a controlled surface roughness is also proposed as disclosed in, for example, JP-T-9-506324 (the term "JP-T" as used herein means a published Japanese translation of a PCT application). The proposed process comprises locally heating the surfaces of sintered quartz glass parts to vitrify them. However, this has also the problem that, when the mechanically-worked surfaces of the sintered quartz glass parts are locally heated, they receive stress and are thereby cracked or cleaved.

A method of forming an extremely thin film of high-purity quartz glass by plasma CVD is proposed as disclosed in, for example, JP-A-6-112133. However, this method also has the problem that, when such a high-purity quartz glass film is formed on parts through plasma CVD, its thickness is at most tens μm or so, and the film is therefore not enough to flatten the rough surfaces of the parts formed of opaque quartz glass and to prevent the diffusion of impurities.

Further proposal is a method of thermal spraying parts with ceramics such as alumina or yttria to thereby coat the parts with the ceramic film, as disclosed in, for example, JP-A-8-339895 and 2001-226773. However, alumina and yttria have the problem as impurities in production of semiconductors as described hereinabove, and they are unsuitable for the thermal spraying material for parts.

In addition to the problem of sealability as described above, another problem in the oxidative diffusion treatment devices and CVD devices for use in semiconductor production is that the thermal efficiency lowers through thermal diffusion from the devices and the throughput in the devices is therefore low.

To solve the problems, proposal is, for example, a method of entirely blackening quartz glass to thereby increase its light shieldability and far-IR radiation to enhance the thermal efficiency in the devices, or a method of increasing the heating rate in the devices, as disclosed in, for example, JP-A-2002-75901.

For blackening quartz glass, for example, a method of adding a compound of V, Mo or Nb or carbon to a material of quartz glass, mixing and melting them under heat is known, as disclosed in, for example, JP-A-54-157121, 5-262535 and 5-306142. In the blacked quartz glass of this type, the blackening substance must be prevented from oxidizing. Therefore, the glass must be melted in a reducing atmosphere or in vacuum, which, however, has the problem that a particular apparatus is necessary for the specific atmosphere control. Another problem in the conventional blackened quartz glass is that, when it is used at high temperatures, the metal element added thereto for blackening it may pollute the area inside the chamber or may crystallize to deteriorate the glass.

Regarding this, a proposal is a method of putting layers of black quartz glass and transparent quartz glass in a heat-resistant mold, and heating and melting them in a vacuum furnace to thereby cover the black quartz glass layer with the layer of transparent quartz glass, as disclosed in, for example, JP-A-2000-256037. However, the problem of deterioration of quartz glass due to crystallization thereof could not be completely solved by that method. In addition, the method has another problem that it requires a large-scaled vacuum furnace and the method itself is troublesome and, in addition, the size of the parts obtainable in the method is limited and the method could not apply to large-sized parts.

On the other hand, another method is considered for producing black quartz glass, which comprises heating quartz glass set in a heating furnace at high temperature of 1,900° C. or higher, and thickening the resulting glass layer by applying quartz glass powder or rock crystal powder thereonto followed by heating and melting it with oxyhydrogen flames or electric arc flames, as disclosed in, for example, JP 3,114,835. However, the method of using oxyhydrogen flames has the problem that the element added to the glass for blackening it is oxidized and the glass is thereby often vitrified. In addition, the method could not still solve the problem of crystallization of quartz glass. In addition, since the accuracy of the thickness and the width of the thickened layer could not be controlled in the method, the parts fabricated in the method must be mechanically worked in post treatment and large-sized quartz glass parts are difficult to fabricate in the method.

As described above, the parts of film-forming devices, oxidative diffusion treatment devices, plasma-treating devices and others have many problems that the deposited film thereon peels away to give particles, their ability to hold the deposited film lowers after repeatedly washed with acid, their surface smoothness is not good therefore causing bonding failure (airtight sealing failure) to other parts, and their energy efficiency is low as their heat insulation is not good.

SUMMARY OF THE INVENTION

As a result of extensive investigations to overcome the above-described problems, it has been found that quartz glass thermal sprayed parts fabricated by thermal spraying quartz glass on a substrate do not crack or cleave, and, in particular, when the surface roughness of the thermal sprayed quartz glass layer is at least 5 μm, the ability of the parts to hold a deposited film thereon is good, and when it is lower than 5 μm, the adhesiveness and the sealability of the parts to and with other parts is good. It has further been found that, when the density and the porous condition of the quarts glass film formed on the parts are varied, the ability of the parts to hold the deposited film thereon and the adhesiveness between the quartz glass film and the substrate is further improved, and even after the parts are washed with hydrofluoric acid, they can still have the ability to hold the deposited film thereon. It has still further been found that the parts coated with a thermal sprayed quartz glass film containing a blackening element introduced thereinto have good heat insulation property and, in addition, deterioration due to crystallization of the quartz glass does not occur.

Moreover, it has been found that the quartz glass thermal sprayed parts can be fabricated by thermal spraying quartz glass on a substrate under the condition that the substrate surface melts. Present invention has been completed base on this finding.

Figure 1:
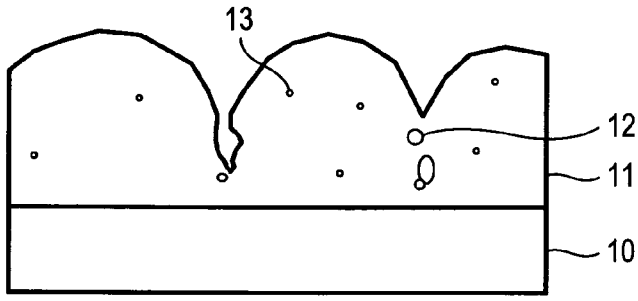
FIG. 1 is a graphical view showing the constitution of the quartz film of a quartz glass thermal sprayed part of the invention (by thermal spraying alone).

In these drawings;

10: substrate
11: quartz thermal sprayed film
12: pore
13: bubble
20: substrate
21: first (lower) quartz glass thermal sprayed film
22: second (middle) quartz glass thermal sprayed film
23: third (upper) quartz glass thermal sprayed film
24: pore
30: substrate
31: quartz glass thermal sprayed film
32: dimple formed in recess of quartz glass thermal sprayed film
33: small dimple formed in dimple
40: cathode
41: anode
42: plasma gas (feeding mouth)
43: thermal spraying powder (feeding mouth)
44: thermal spraying distance
45: substrate (quartz glass or metal or ceramics)
46: quartz glass thermal sprayed film
47: power source
50: cathode
51: anode
52: plasma gas (feeding mouth)
53: thermal spraying powder (feeding mouth)
54: thermal spraying distance
55: substrate (quartz glass or metal or ceramics)
56: quartz glass thermal sprayed film
57: plasma gas (feeding mouth)
58: main power source
59: auxiliary power source
100: quartz glass (substrate)
101: crack in blasted surface of substrate
110: quartz glass (substrate)
111: gently-sloping shallow dimple

DETAILED DESCRIPTION OF THE INVENTION

The invention is described in detail below.

The invention provides a quartz glass thermal sprayed part with a quartz glass film having a surface roughness Ra of from 5 to 100 μm formed on the surface of a substrate.

By forming the quartz glass thermal sprayed film having a surface roughness Ra of from 5 to 100 μm thick on the surface thereof, the substrate has an increased surface area, thereby improving its ability to hold a deposited film thereon. If its Ra is smaller than 5 μm, the ability of the sprayed substrate to hold the deposited film thereon is not sufficient, and if it is larger than 100 μm, the surface of the coated substrate is too rough and the mechanical strength of the quartz glass thermal sprayed film formed on the substrate decreases. Substrates roughened through conventional blasting, especially when the substrate is made of glass, are the problem that they have microcracks and therefore their mechanical strength lowers. As opposed to those, the quartz glass thermal sprayed part of the invention is free from the problem.

The surface roughness Ra as referred to herein can be measured with an ordinary profilometer.

The surface profile of the quartz glass thermal sprayed film is not particularly limited so far as the surface roughness thereof falls within the above-defined range. However, the film surface preferably has rounded hillocks and steep V-shaped valleys between the hillocks. More preferably, the distance between the hillocks is 2 mm or less, preferably 1 mm or less, for the ability of the film-coated substrate to hold the deposited film thereon. If it is larger than 2 mm, the ability of the film-coated substrate to hold the deposited film thereon is liable to lower. The distance between the hillocks can be measured with an optical microscope, an electronic microscope, a profilometer, etc. FIG. 1 shows a graphical view of one embodiment of the quartz glass thermal sprayed film formed through thermal spraying on a substrate in the invention.

For further improving the ability of the quartz glass part of the invention to hold a deposited film thereon, it is more desirable that the rough surface of the quartz glass film further is a surface having further fine granular projections. The granular projections should not readily peel or drop off, and must firmly bond to the surface of the quartz glass thermal sprayed film.

For ensuring the ability of the quartz glass thermal sprayed film on the part of the invention to hold the deposited film thereon, it is desirable that at least the portion near the surface of the film is porous and has a relative density of from 60 to 95%.

On the other hand, the quartz glass thermal sprayed film must have a mechanical strength to some degree, and its relative density is more preferably 70% or more. However, if the relative density of the film is higher than 95%, the ability thereof to hold a deposited film thereon will become insufficient.

The relative density of the quartz glass thermal sprayed film can be measured by an ordinary Archimedes' method. The theoretical density (100% relative density) of quartz glass is 2.20 g/cm$^3$.

Preferably, the quartz glass thermal sprayed film in the invention has a density gradient such that its relative density decreases toward the direction of from the quartz glass interface (lower part) to the surface of the quartz glass thermal sprayed film (upper part).

The density gradient of the quartz glass thermal sprayed film can be attained by depositing multiple quartz glass layers having different relative density on a substrate by repeated thermal spraying operations. In case where the deposited film is composed of two layers, the upper and lower layers have difference in density (gradient) therebetween, and in case where the film is composed of three layers, the upper, middle and lower layers have difference in density among them. In case where the number of the layers to constitute the film is further more, the layered film can have a further thinned gradient change in the constitutive layers. The quartz glass thermal sprayed part having the density gradient as above can maintain its good surface profile to ensure its ability to hold a deposited film thereon even after its surface is etched through washing with nitric acid/hydrofluoric acid, etc.

In case where the quartz glass thermal sprayed film is formed to have such a density gradient, it is desirable that at least the relative density of the first layer of the film, that contacts with the substrate, is from 95 to 100%. If the relative density of the first layer of the film is low, it is undesirable since the adhesiveness between the quartz glass thermal sprayed film and the quartz glass substrate is low. On the other hand, it is desirable that the relative density of the layer above the first layer contacting with the substrate, that is, the relative density of the layer nearer to the surface of the thermal sprayed film is lower than that of the first layer. Specifically, the relative density of the upper layer is preferably from 50 to 90%, more preferably from 70 to 90%.

The density of the quartz glass thermal sprayed film can be determined by observing the cross section of the film with a scanning electronic microscope followed by processing the image data. Specifically, the area of pores and bubbles existing in the film is subtracted from the cross-sectional area of the quartz glass thermal sprayed film, and the resulting difference is divided by the cross section of the film and then multiplied by 100. The resulting product indicates the relative density of the film.

Figure 2:
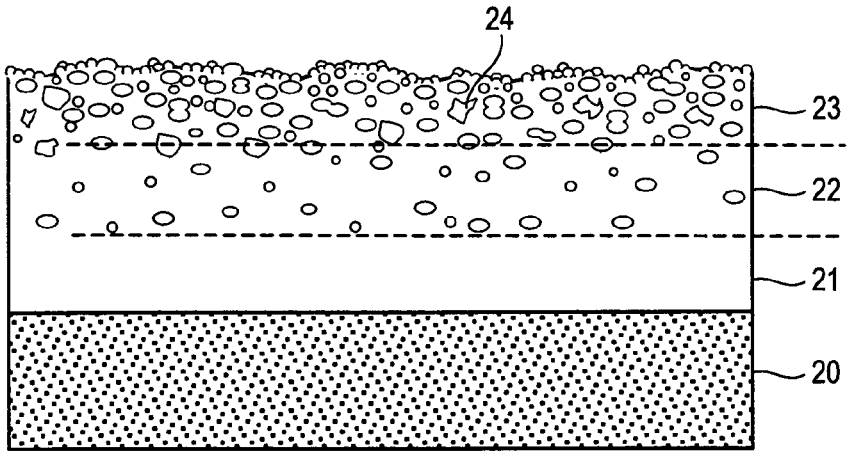
FIG. 2 is a graphical view showing the constitution of the quartz film of a quartz glass thermal sprayed part of the invention (having a density gradient).

FIG. 2 is a graphical view showing a quartz glass thermal sprayed part of the invention in which the quartz glass film is composed of three layers (upper layer, middle layer, lower layer).

When etched with nitric acid/hydrofluoric acid, the quartz glass thermal sprayed film having a density gradient again gives a complicated surface profile. Therefore, even after repeatedly washed with nitric acid/hydrochloric acid, the ability of the film to hold a deposited film thereof is still high. Contrary to this, when quartz glass parts blasted in an ordinary manner are washed with nitric acid/hydrofluoric acid, their surfaces become flattened and, as a result, their ability to hold a deposited film thereon lowers after the washing. However, when the quartz glass thermal sprayed parts of the invention are washed with acid, their surfaces begin to dissolve along the particles melt-deposited therein, and therefore the dissolution goes on irregularly since the film has a density gradient in the direction of its thickness, and the thus-dissolved surfaces are thereby roughened.

Preferably, the quartz glass thermal sprayed parts of the invention have bubbles in the quartz glass thermal sprayed film thereof. The condition of the bubbles present in the film is shown in the schematic views of FIG. 1 and FIG. 2.

Also preferably, the bubbles in the quartz glass thermal sprayed film are fine bubbles having a size of smaller than 100 μm. The fine bubbles in the quartz glass thermal sprayed film are pores independently existing in the film. The size of the bubbles is smaller than 100 μm, preferably from 2 to 20 μm. The presence or absence of the bubbles can be confirmed by microscopic observation of the cross section of the quartz glass thermal sprayed film.

The number of the bubbles is not particularly limited, and about 1 to 100 bubbles, per one hillock of the quartz glass thermal sprayed film in microscopic observation of the cross section of the film, are sufficient.

When the porous quartz glass thermal sprayed film is etched with a solution containing hydrofluoric acid, the bubbles are exposed out on the surface of the film and the surface is thereby roughened. Accordingly, even after the film is repeatedly washed with hydrofluoric acid, high ability to hold a deposited film thereon is still maintained.

Preferably, the quartz glass thermal sprayed part of the invention does not have a pore of 100 μm or larger in the interface between the quartz glass thermal sprayed film and the substrate, and it is desirable that the film airtightly adheres to the substrate. If there exist some pores of 100 μm or larger in the interface between the quartz glass thermal sprayed film and the substrate of the quartz glass thermal sprayed part, the film will peel away from the substrate in the interface therebetween and its durability is not sufficient.

Figure 3:
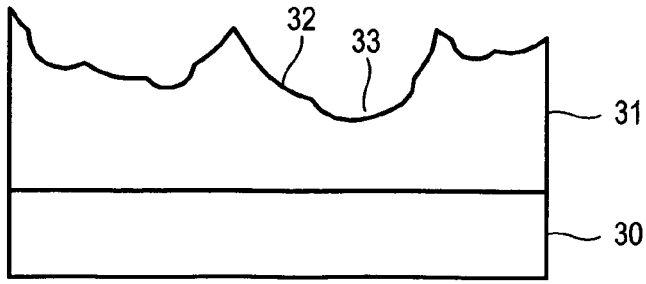
FIG. 3 is a graphical view showing the constitution of the quartz film of a quartz glass thermal sprayed part of the invention (by thermal spraying and then etching with hydrofluoric acid).

The quartz glass thermal sprayed part of the invention is washed with hydrofluoric acid to have a surface roughness Ra of from 10 to 200 μm, and dimples are formed in the recesses of the thus-roughened surface of the part. The invention encompasses the thus-roughened, quartz glass thermal sprayed part. The ability of the quartz glass thermal sprayed part of the type to hold a deposited film thereon is good and the part gives few particles, like that before washed with the acid. FIG. 3 is a graphical view showing the quartz glass thermal sprayed part of the invention that has been washed with hydrofluoric acid.

In the roughened surface of the quartz glass thermal sprayed film of this part, it is desirable that one or more dimples are formed in one recess and the surface roughness Ra of the film falls between 10 and 200 μm, more preferably between 20 and 100 μm. When the quartz glass thermal sprayed film is etched with hydrofluoric acid and when Ra of the thus-etched film is smaller than 10 μm, the ability of the film to hold a deposited film thereon is not sufficient. On the other hand, the upper limit of Ra can be allowable up to 200 μm. This is because the quartz glass thermal sprayed film having a complicated surface profile with dimples therein can still have good mechanical strength even when the surface roughness Ra is 200 μm.

Preferably, the diameter of the recess in the quartz glass thermal sprayed film is from 0.05 to 1 mm, more preferably from 0.1 to 0.5 mm. If it is smaller than 0.05 mm, the recess is too small and the ability of the thermal sprayed film to hold a deposited film thereon will be poor; but if larger than 1 mm, the surface of the thermal sprayed film is smooth and the ability thereof to hold a deposited film thereon is also poor. The diameter of the recess can be measured with a microscope and a profilometer.

Regarding the number of the dimples in the surface recess, one dimple can be present in one recess, but the number of the dimples in each recess is preferably larger for better ability of the thermal sprayed film to hold a deposited film thereon. When smaller dimples are further formed in the dimple, it is more desirable for further improving the ability of the film to hold a deposited film thereon. The diameter of the smaller dimple in the primary dimple should be smaller than that of the primary dimple, preferably falling between 5 μm and 500 μm.

When ordinary blasted quartz glass parts are etched with a solution containing hydrofluoric acid, the recesses formed in their surfaces are larger than those formed in the surface of the part of the invention. In addition, no dimple is formed in the dimples formed in the etched surfaces. Therefore, even after etched, the ability of the ordinary blasted quartz glass parts to hold a deposited film thereon is still poor. Moreover, the ordinary blasted quartz glass parts have neither the density gradient nor the bubbles below the microcracks therein, like those in the invention, and therefore, when etched with hydrofluoric acid, they are uniformly dissolved and could not have a complicated surface profile as in the invention.

It is desirable that the substrate for the quartz glass thermal sprayed parts of the invention is mainly of quartz glass, but may also be metals or ceramics. In case where the substrate is formed of metals, the type of the metals is not particularly limited. It is preferable for the substrate to use heat-resistant materials such as stainless, inconel or titanium, or materials of low thermal expansion such as invar alloy. In case where a metal having a low melting point such as aluminum is used for the substrate, it is desirable that the quartz glass thermal sprayed film is formed thereon via a film previously formed on the substrate by thermal spraying a heat-resistant metal or ceramic material thereon. In case where a ceramic material is used for the substrate, the ceramic is preferably highly resistant to thermal shock. Example of such ceramics include alumina, zirconia, cordierite, silicon carbide, silicon nitride and mullite.

The thickness of the quartz glass thermal sprayed film in the quartz glass thermal sprayed parts of the invention is not particularly limited. The parts having a thick film can be reused many times through washing with nitric acid/hydrofluoric acid. Therefore, the thickness of the film is preferably at least 0.1 mm. However, if the film is too thick, the dimensional accuracy of the parts will lower. Therefore, it is desirable that the thickness of the film is 1 mm or less.

The quartz glass thermal sprayed part of the invention preferably has a mean inclination angle of the hillocks and recesses in the quartz glass thermal sprayed film of at least 20°. If the angle is smaller than 20°, the surface of the film will be smooth and the ability thereof to hold a deposited film thereon will be poor. The upper limit of the angle is not particularly limited, but is preferably from 30 to 50°. If the angle is larger than 60°, the surface of the film will be too rough and the mechanical strength thereof will be low. The mean inclination angle of the hillocks and the recesses of the film can be determined by observation of the cross section of the film with a scanning electronic microscope. At least 10 points or so are measured, and their data shall be averaged.

It is preferable for the quartz glass thermal sprayed film in the invention to have a high purity, for example, at least 99.9%, more preferably at least 99.99%. In particular, when the quartz glass thermal sprayed parts of the invention are used in production of semiconductors and the like, it is desirable that ultrahigh-purity quartz glass having a purity of at least 99.99% is spray coated on the substrate. The impurities, if any, in the film are mainly metal impurities (e.g., alkali metals, alkaline earth metals, heavy metals).

The invention also provides a quartz glass thermal sprayed part with a quartz glass thermal sprayed film having a surface roughness Ra of from 0.001 μm to less than 5 μm formed on the surface of a substrate.

The part with a quartz glass thermal sprayed film having a surface roughness Ra of smaller than 5 μm well adheres to and airtightly seals with any other part (e.g., sealants). However, the lower limit of the surface roughness Ra of the film formed by thermal spraying is 0.001 μm.

Preferably, the quartz glass thermal sprayed film having a surface roughness Ra of smaller than 5 μm in the invention have no bubble inside the film. If the film has some bubbles therein, those may be exposed out on the surface of the film to deteriorate the surface smoothness of the film. Absence of bubble in the film is desired. However, it is difficult to obtain a film with no bubble at all by thermal spraying, and it is therefore desirable that the film does not have large bubbles having a diameter of at least 100 μm. Also preferably, the number of small bubbles of from 10 to 100 μm in size in the film is at most 10,000/cm$^3$. The presence or absence of bubbles in the film can be confirmed visually or with microscopic observation. The bubbles exposed out on the surface of the film can be confirmed with a surface roughness meter.

In case where the quartz glass thermal sprayed film of the quartz glass thermal sprayed part of the invention is thick, the part can be reused many times by washing with nitric acid/hydrofluoric acid. Therefore, the thickness of the film is preferably 0.1 mm or more. However, if the film is too thick, the dimensional accuracy of the parts will lower. Therefore, it is desirable for the film to have a thickness of 5 mm or less, preferably 2 mm or less.

The quartz glass thermal sprayed part of the invention may be any part so far as a smooth quartz glass thermal sprayed film is spray coated on a substrate. Preferably, a porous opaque quartz glass thermal sprayed film is formed between the substrate and the quartz glass thermal sprayed film. This is because, when a quartz glass thermal sprayed film alone is formed directly on a metal or ceramic substrate, it may be cracked, cleaved or deformed due to the difference in the thermal expansion coefficient between the substrate and the quartz glass. As opposed to this, when such a porous opaque quartz glass thermal sprayed film is formed between the quartz glass thermal sprayed film and the substrate, it acts to prevent the quartz glass thermal sprayed film from being cracked, cleaved or deformed due to the thermal expansion difference.

In addition, when the porous opaque quartz glass thermal sprayed film is formed between the quartz glass thermal sprayed film having a dense surface and the substrate, the heat insulation of the quartz glass thermal sprayed part is improved since the opaque quartz glass layer has excellent heat-insulating property. Due to this effect, the part (e.g., sealants) contacting with the quartz glass thermal sprayed part is prevented from being thermally deteriorated.

One porous opaque quartz glass thermal sprayed film layer may be present between the substrate and the smooth quartz glass thermal sprayed film. However, multiple quartz glass thermal sprayed films may be alternately laminated on the substrate so far as the quartz glass thermal sprayed film having the surface roughness falling within the range defined in the invention is the outermost layer of the laminate.

The porosity of the opaque quartz glass thermal sprayed film layer preferably falls between 5% and 50%, more preferably between 10% and 30% by volume. If it is smaller than 5%, the ability of the layer to absorb stress is poor and the layer could not be prevented from cracking and cleaving and its heat insulation will be unsatisfactory. On the other hand, if it is larger than 50%, the mechanical strength of the film itself is decreased, which is not desirable. The bubbles in the opaque quartz glass thermal sprayed film can be visually confirmed when the substrate is formed of transparent quartz glass. The bubbles can also be confirmed by microscopically analyzing the cross section of the opaque quartz glass thermal sprayed film.

The thickness of the opaque quartz glass thermal sprayed film layer is not particularly limited, but is preferably from 0.1 to 3 mm, more preferably from 0.3 to 1 mm, for making the film layer have stress relaxation and heat insulation effects.

The quartz glass thermal sprayed film in the invention preferably has a high purity, such as 99.9% or more, preferably 99.99% or more. In particular, when the quartz glass thermal sprayed parts of the invention are used as parts for the production of semiconductors and the like, it is preferable to use the quartz glass thermal sprayed film having an ultra-high purity of 99.9999% or more. Impurities in such a purity as used herein mean mainly metal impurities (e.g., alkali metals, alkaline earth metals, and heavy metals).

The substrate of the quartz glass thermal sprayed parts can use not only quartz glasses but also metals or ceramics. Although not particularly limited, examples of the substrate include stainless, inconel, titanium, invar alloy, aluminum, alumina, zirconia, cordierite, silicon carbide, silicon nitride and mullite.

In case where quartz glass is used for the substrate, any of transparent quartz glasses, opaque quartz glasses or black quartz can be used. The parts obtained by covering an opaque quartz glass substrate with a transparent quartz glass thermal sprayed film have improved resistance to nitric acid/hydrofluoric acid as compared with parts not covered with the transparent quartz glass thermal sprayed film. The opaque quartz glass used can be any of opaque quartz glasses containing bubbles therein or colored quartz glasses having hetero elements added thereto. The quartz glass substrate is preferably formed of a high-purity quartz glass material, for example, a quartz glass material produced by purifying natural rock crystal followed by melting it in an oxyhydrogen melting furnace or a plasma melting furnace, or a synthetic quartz glass material produced by hydrolyzing high-purity silicon tetrachloride with oxyhydrogen flames.

The invention further provides a quartz glass thermal sprayed part with a black quartz glass film formed on a substrate.

The quartz glass thermal sprayed parts of the invention are used for chambers or bell jars to be used in oxidative diffusion treatment devices, CVD film-forming devices, plasma-processing devices, lamp annealing devices, etc. Therefore, it is desirable that a black quartz glass thermal sprayed film is formed at least partly in the area of the substrate to be shielded from light or heat. The parts with such a black quartz glass thermal sprayed film formed on a substrate have excellent far infrared radiatiomn property as well as excellent light shielding property and heat shielding property.

The shape of the substrate used in the invention is not particularly limited, and the substrate can have any shape including tabular, domed, ring-shaped or tubular shape.

The material of the substrate is not particularly limited. In particular, quartz glass substrate of good light shielding property and heat insulation property are preferred for use in the invention as producing better results. In case where the substrate is formed of quartz glass, any of transparent quartz glass or opaque quartz glass can be used. Opaque quartz glass substrates scatter IR rays and are impervious to visible rays. Therefore, those are especially effective for heat insulation property. In particular, high-purity quartz glass, for example, a quartz glass material produced by purifying natural rock crystal followed by melting it in an oxyhydrogen melting furnace or a plasma melting furnace, or a synthetic crystal glass material produced by hydrolyzing high-purity silicon tetrachloride with oxyhydrogen flames, is especially preferred.

The thickness of the quartz glass substrate is preferably 0.5 mm or more in order that it is not broken by the pressure of the plasma jet to be applied thereto during film formation of a thermal sprayed film. However, the thickness is preferably 30 mm or more in order that it is not cracked by the thermal shock during thermal spraying.

Preferably, the blackening element to be in the black quartz glass thermal sprayed film is at least one selected from a group consisting of Nb, V, Mo and C. The amount of the blackening element added to the thermal sprayed film is not particularly limited, but is generally 0.1 to 10% by weight based on the weight of the film.

Though varying depending on the type or the amount of the blackening element, the thickness of the black quartz glass thermal sprayed film is preferably 0.3 mm or more for better light shielding property and far infrared radiation property.

The quartz glass thermal sprayed part of the invention is preferably that a transparent quartz glass thermal sprayed film and/or an opaque quartz glass thermal sprayed film is further laminated on the black quartz glass thermal sprayed film.

Lamination of a quartz glass thermal sprayed film on the black quartz glass thermal sprayed film prevents the inside area of the chamber from being polluted by the blackening element. For more surely protecting the inside area of the chamber from being polluted, the thickness of the additional quartz glass thermal sprayed film to be laminated on the black quartz glass thermal sprayed film is preferably 0.3 mm or more, more preferably from 1 to 3 mm.

The additional quartz glass thermal sprayed film to be laminated may be any of transparent quartz or opaque quartz. The opaque quartz glass may contain some element for making it opaque or may be foamed for making it opaque. For preventing the chamber pollution, it is desirable that the opaque quartz glass does not contain a blackening element but is foamed.

The black quartz glass thermal sprayed film laminated with such an opaque quartz glass thermal sprayed film scatters infrared rays and is impervious to visible rays, and therefore it is more effective for heat insulation property.

The substrate for the black quartz glass thermal sprayed parts include can use not only quartz glass but also metal or ceramics. Although not particularly limited, examples of the substrate include stainless, inconel, titanium, invar alloy, aluminium, alumina, zirconia, cordierite, silicon carbide, silicon nitride, and mullite.

As compared with conventional black quartz glass parts, the black quartz glass thermal sprayed parts of the invention are not degraded by crystallization. In particular, they are almost not degraded by crystallization in a high-temperature oxidizing atmosphere. The reason will be because of the difference between the texture constitution of the film formed through thermal spraying and that of the bulk formed from molten quartz glass, specifically because the reducing gas used in the process of thermal spraying may be taken into the film formed and the film will be thereby prevented from crystallizing.

A method for producing the quartz glass-sprayed parts of the invention is described below.

When a quartz glass thermal sprayed film is formed on a substrate using a thermal spraying process to form the quartz glass thermal sprayed parts of the invention, the quartz glass material to form the film is spray coated on the substrate under the condition that the surface of the substrate melts.

The conditions that the surface of the substrate melts in the thermal spraying process are set by varying the distance between the spraying nozzle and the substrate, the spraying power and the thermal spraying gun moving speed relative to the various substrates before the quartz glass material is not as yet fed in the spray apparatus. Specifically, when the surface of the substrate that has been scratched by blasting or the like is smoothed by plasma irradiation thereto and when the smoothed surface of the substrate after the plasma irradiation thereto is confirmed through microscopic observation, then it is the condition that the surface of the substrate melts. For example, where the substrate is a quartz glass, the quartz glass has a melting point of about 1,800° C. Therefore, the condition can be attained by that at least the surface of the quartz glass is the melting point or higher by adjusting the above conditions.

In the invention, the spraying material that has been melted by plasma colloids against the melted surface of the substrate to deposit thereon. Therefore, the adhesiveness of the thermal sprayed film to the substrate is high. Contrary to this, if quartz powder is spray coated on the substrate under the condition that the substrate surface does not melt, the quartz powder does not deposit on the substrate or, if deposited, the film of the invention is not formed, even if the substrate is pretreated by, for example, blasting.

The substrate should be melted only in its surface. If the substrate is melted entirely, it is unfavorable since the substrate will be deformed.

Figure 4:
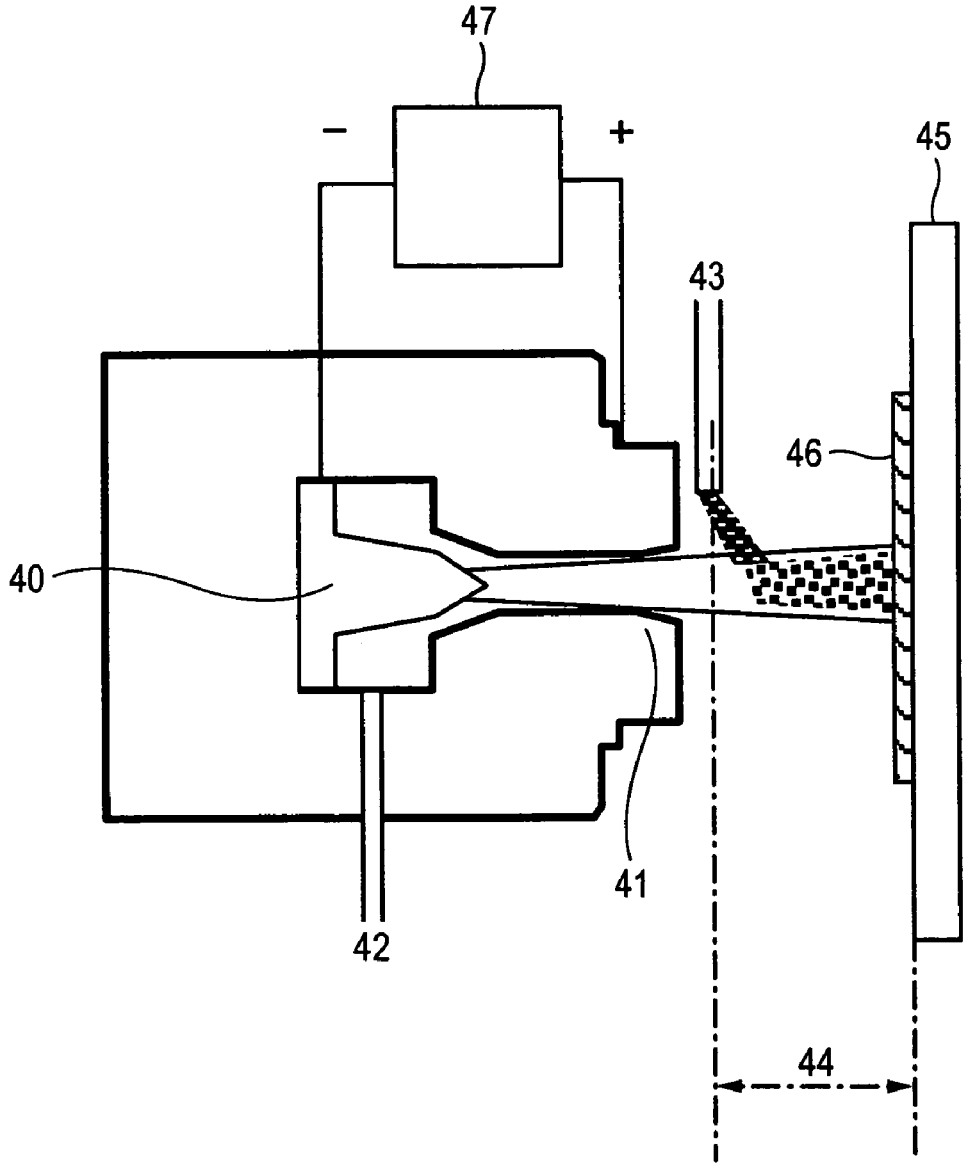
FIG. 4 is a schematic view showing one example of an ordinary plasma thermal spraying apparatus.

The thermal spraying method used in the invention is not particularly limited, but it is preferable to use plasma thermal spraying or flame thermal spraying. When a plasma thermal spraying apparatus as in FIG. 4 is used, the spray distance 44 between the substrate 45 and the powder supply mouth 43 at the tip of the spray gun should be short, for example, 70 mm or less, preferably about 50 mm, in order that the surface of the substrate 45 melts under the thermal spraying condition.

Figure 5:
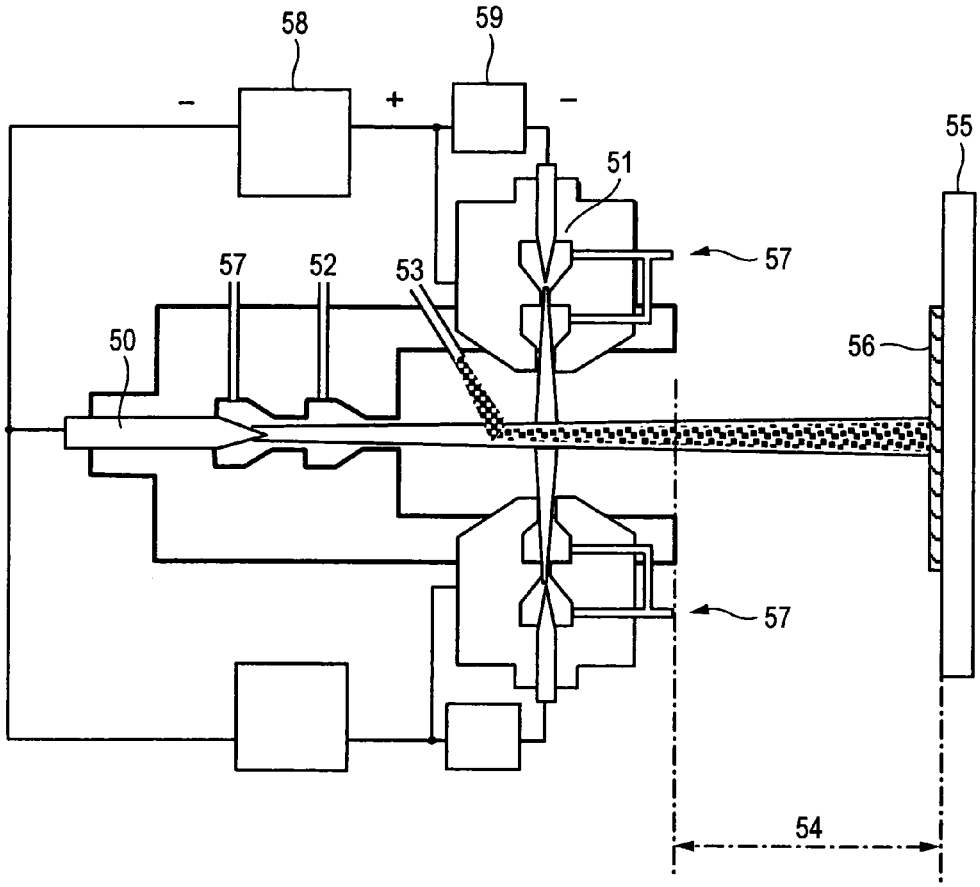
FIG. 5 is a schematic view showing one example of a multi-torch plasma thermal spraying apparatus used for forming a quartz film on a quartz part of the invention.

Apart from the above-mentioned ordinary plasma thermal spraying method, a multi-torch plasma thermal spraying method (JP-B 6-22719; *Thermal Spraying Technology*, Vol. 11, No. 1, pp. 1–8, 1991), and a water plasma thermal spraying method can also be used. FIG. 5 shows an outline of a multi-torch plasma thermal spraying apparatus. In the multi-torch plasma thermal spraying method as shown, the thermal plasma can be in a laminar flow by decreasing the gas flow rate, so that the spray distance can be prolonged.

After quartz glass thermal spraying, the substrate may be washed with acid to remove the impurities that have been in the spraying material, thereby obtaining a clean thermal sprayed film. The acid washing is preferably conducted using nitric acid optionally containing a small amount (less than 5% by weight) of hydrofluoric acid.

During the thermal spraying, the surface of the substrate is locally heated high, and the deformation of the substrate due to thermal expansion cannot be negligible. Due to this, the substrate may be cracked or broken. Especially for large-size substrates, therefore, it is desirable that the substrates are spray coated with quartz glass powder while they are heated on their front face or back face.

The quartz glass material used for thermal spraying in the invention has a mean particle size of from 20 to 150 μm in the form of powder. Having the mean particle size that falls within the range, the powder material can be stably fed into spraying devices and a uniform thermal sprayed film is easy obtained. However, too fine powder having a mean particle size of smaller than 20 μm may clog spray nozzles and its stable supply in spraying devices will be difficult, and a uniform film is difficult to form from it. On the other hand, coarse powder having a mean particle size of larger than 150 μm will form a porous film, and a dense film is difficult to form from it.

The purity of the quartz glass material for use herein is not particularly limited, but is preferably as high as possible to form a high-purity quartz glass thermal sprayed film. Specifically, the material is synthetic quartz glass powder prepared by hydrolyzing high-purity silicon tetrachloride with oxyhydrogen flames. In case where the synthetic quartz glass powder prepared by hydrolyzing high-purity silicon tetrachloride with oxyhydrogen flames is used for the material to be spray coated on the substrate, a quartz glass thermal sprayed film having a purity of 99.9999% or more can be formed.

In flame thermal spraying, the particles not in the center of the spraying flames may deposit on the surface of the quartz glass-spray coated substrate. Most of such particles weakly bond to the substrate. It is desirable that the particles thus weakly bonding to the substrate are removed by washing the quartz glass-spray coated substrate with 5–10% hydrofluoric acid for 0.5 to 1 hour. For removing the particles, flames alone may be applied to the surface of the quartz glass-spray coated substrate with no film-forming material applied thereto, and the particles may be melted by the flames.

In the invention, it is desirable that the substrate is preheated at a temperature failing between 600° C. and 1200° C. Preheating the substrate is effective for generating fine pores in the quartz glass-spray coated film formed on the substrate through thermal spraying, and large pores of 100 μm or more are not present in the interface between the quartz glass thermal sprayed film and the substrate. If the substrate is not preheated, or even though preheated at a temperature lower than 600° C., the quartz glass thermal sprayed film formed on the substrate by thermal spraying will be porous, having large pores of 100 μm or more in the interface between the substrate and the quartz glass film. If so, the adhesiveness between the porous film and the substrate is poor, and the film will be readily peeled.

In case where multiple quartz glass films are formed in layers in the invention, the heat supply by spraying flames may be reduced to make the layered film have a density ingredient.

In thermal spraying with quartz glass, a relatively denser film having a higher density may be formed when the quantity of heat supplied by spraying flames is larger. Contrary to this, however, when the quantity of heat supplied is smaller, a coarser film having a lower density may be formed.

The heat supply in thermal spraying with quartz glass may be controlled by varying the distance between the spray gun and the substrate, the electric power applied to the spraying system, and the moving speed of the spray gun.

In thermal spraying to form a quartz glass film on a substrate, in general, multiple layers each having a thickness of from tens to hundreds μm are formed to give a multi-layered quartz glass film. In the invention, the substrate is well preheated and a first thermal sprayed layer is formed thereon with a largest quantity of heat applied thereto. Then, the quantity of heat is stepwise decreased by controlling the thermal spraying flames for the subsequent thermal sprayed layers. Thus formed in the manner of controlled thermal spraying, the relative density of the multi-layered quartz glass film gradually decreases from the interface of the substrate (lowermost layer) toward the top face of the quartz glass film (uppermost layer), or that is, the multi-layered quartz glass film thus formed may have a density gradient that increases toward the lower layers.

Next, the quartz glass thermal sprayed part is etched with a liquid that contains hydrofluoric acid, whereby its surface is roughened and dimples are formed in the recesses of the roughened surface. Thus processed, the quartz glass thermal sprayed part may have a surface roughness, Ra, of from 10 to 200 μm.

Etching with hydrofluoric acid may be repeated many times. Those once etched with hydrofluoric acid may be again etched with hydrofluoric acid. Etching may be repeated at least until the quartz glass film is completely dissolved out.

The etchant used may be any one that contains hydrofluoric acid. It may optionally any other inorganic acid such as nitric acid. For example, the etchant is a mixed acid of hydrofluoric acid and nitric acid in a ratio of from 1/1 to 1/3. For example, when a quartz glass film having a thickness of 0.6 mm is completely removed through etching with an etchant having a hydrofluoric acid concentration of 24%, it will take about 18 hours. Therefore, the etching time is preferably from 0.5 to 24 hours, more preferably from 0.5 to 18 hours. If the etching time is too short, formation of dimples will be unsatisfactory; but if too long, the quartz glass film will be dissolved too much and the life of the quartz glass thermal sprayed parts will be thereby shortened.

Next in the invention, the quartz glass film formed on a substrate through thermal spraying may be exposed to plasma jets with no thermal spraying material being applied thereto. The film surface is thereby melted, and its surface roughness Ra may be from 0.001 μm to less than 5 μm.

In the invention, film formation on a substrate is effected while the substrate is heated with plasma jets or while the thermal sprayed film previously formed on the substrate is melted with plasma jets. When the thermal sprayed film that has been deposited on the surface of a substrate is melted with plasma jets applied thereto, its surface roughness Ra may be smaller than 5 μm. In this case, the power for the plasma thermal spraying may be, for example, from 25 to 35 kW or more.

The plasma gas for plasma jets with no spraying material is preferably a mixed gas of inert gas and hydrogen. Hydrogen in the plasma gas is effective for more easily processing thermal sprayed films to make them have few bubbles and have a good surface smoothness. When hydrogen is added to inert gas for the plasma gas, the amount of hydrogen is preferably from 10 to 50% by volume, more preferably from 10 to 30% by volume. The inert gas may be any of helium, neon, argon, krypton or nitrogen. For industrial use, especially preferred is argon or nitrogen.

Regarding the frequency of irradiation with plasma jets, once will be enough so far as it melts the surface of the thermal sprayed film. However, for obtaining films of higher surface smoothness, the irradiation may be repeated several times.

In the invention, a porous opaque quartz glass film layer may be formed between the substrate and the quartz glass film to be formed thereon through thermal spraying.

For forming the opaque quartz glass film layer on the substrate through thermal spraying, the quantity of heat to the unit area of the substrate from the plasma jet is reduced whereby the bubbles in the thermal sprayed film layer is increased. For reducing the quantity of heat to the unit area of the substrate from the plasma jet, for example, the spraying power may be reduced, the spraying distance may be prolonged, or the moving speed of the spray gun may be increased.

Apart from the above-mentioned method of varying the heat of quantity per the unit time to the substrate for producing the porous opaque quartz glass film on the substrate, another method may be employed which comprises adding fine silicon nitride powder to the spraying powder and spraying the resulting mixed powder toward the substrate. In this method, cracked gas is generated while the powder is sprayed on the substrate and the thermal sprayed film is foamed by the gas. Using the material, the thermal sprayed film may be foamed even though the spraying condition is not varied. In case where fine silicon nitride powder is added to the spraying powder, it is desirable that the mean particle size of the silicon nitride powder is from 0.5 to 5 μm and the amount of the silicon nitride powder to be added is from 0.03 to 3% by weight. If the mean particle size of the silicon nitride powder is smaller than 0.5 μm, the silicon nitride powder will be difficult to uniformly mix with the spraying powder of quartz; but if larger than 5 μm, the diameter of the bubbles that may be formed in the thermal sprayed film will be larger than 500 μm and the mechanical strength of the film will be low. If the amount of the silicon nitride powder added is smaller than 0.03% by weight, good bubbles could not be formed in the thermal sprayed film; but if larger than 3% by weight, it is unfavorable since the bubbles formed may bond together to be large bubbles and the bubbles could not be uniformly dispersed.

Next, especially when a thermal sprayed film of blackened quartz glass is formed in the quartz glass thermal sprayed parts of the invention, a plasma thermal spraying method is preferably employed. In the method, it is desirable that an inert gas or a mixed gas of inert gas with hydrogen gas and/or hydrocarbon gas is used for the plasma gas, and the film-forming material is sprayed on the substrate while the surface of the substrate or the surface of the previously formed film is melted with plasma jets.

According to the plasma thermal spraying method of using, as the plasma gas, an inert gas alone or a mixed gas of inert gas with hydrogen gas and/or hydrocarbon gas, the element added to the spraying material for blackening quartz glass is not oxidized and a good black quartz film can be formed. In particular, since the reducing gas is taken in the thermal sprayed film, the crystallization of quartz glass by the blackening element may be retarded.

The inert gas may be any of helium, neon, argon or nitrogen. For industrial use, preferred is argon or nitrogen. In case where hydrogen gas is added to the plasma gas, its concentration is preferably from 5 to 50%, more preferably from 5 to 30%. The hydrocarbon gas includes, for example, methane, ethane, propane, ethylene and acetylene, and its concentration is preferably from 5 to 50%, more preferably from 5 to 30%.

For the thermal spraying material for the black quartz glass film, for example, employable is any of a mixture prepared by mixing a powder of at least one blackening element selected from Nb, V, Mo and C with quartz glass powder or rock crystal powder in such a manner that the blackening element powder may adhere to the quartz glass or rock crystal particles and that the blackening element may account for from 0.1 to 10% by weight of the thermal sprayed film; a sintered powder obtained by mixing quartz glass powder or rock crystal powder with powder of the above-mentioned blackening element or its compound in a ball mill or the like, then spray-drying the resulting mixture to give granules and sintering the resulting granules; or a ground powder obtained by adding powder of the above-mentioned blackening element or its compound to quartz glass powder or rock crystal powder to give a black glass bulk followed by powdering the resulting bulk.

Preferably, a transparent or opaque quartz layer is laminated on the black quartz glass film, as it is effective for preventing the diffusion of the blackening element from the film that contains it and for further improving the heat shielding property of the black quartz glass film. When an opaque quartz layer is laminated on the film, it is desirable that any hetero element is not added to the additional layer for making the layer opaque but the additional layer is foamed so as to make it opaque, from the viewpoint of preventing the diffusion of impurities. For forming the porous opaque quartz glass film layer through thermal spraying, for example, the method mentioned hereinabove may be employed.

The invention is described in more detail with reference to the following Examples, which, however, are not intended to restrict the scope of the invention.

EXAMPLE 1

Using a plasma thermal spraying apparatus as in FIG. 4, a quartz glass film was formed on a polished quartz glass substrate. The plasma thermal spraying condition is shown in Table 1. To define the thermal spraying condition, a test sample of a blasted quartz glass substrate was tried. The condition under which the surface of the test sample melted to be transparent was employed for the thermal spraying condition in this Example.

A quartz glass thermal spraying material having a mean grain size of 15 μm, 30 μm, 50 μm or 80 μm was sprayed on the substrate to produce quartz glass thermal sprayed parts, in which the quartz glass film formed had a surface roughness Ra of 12, 23, 35 or 46 microns and a relative density of 88, 78, 70 or 65%, respectively.

Figure 6:
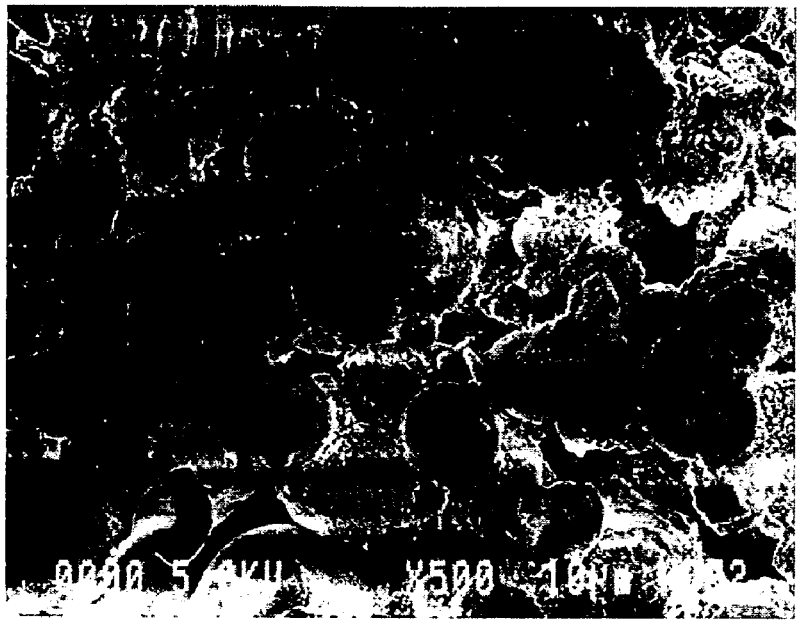
FIG. 6 is one example of the surface SEM image of a quartz film in the invention (by thermal spraying alone and having a surface roughness of at least 5 μm).

FIG. 6 is a SEM image of the surface of the quartz glass thermal sprayed part produced herein.

COMPARATIVE EXAMPLE 1

Plasma thermal spraying was effected in the same manner as in Example 1, in which, however, the thermal spraying distance was changed to 120 mm. In this condition, the thermal plasma could not well reach the surface of the substrate, and the surface of the substrate did not melt. Next, a quartz material was thermal sprayed onto a polished quartz glass substrate for film formation thereon, under the same condition as above. However, no film was formed on the substrate.

EXAMPLE 2

Using a multi-torch plasma thermal spraying apparatus as in FIG. 5, the same substrate as in Example 1 was plasma thermal sprayed with quartz glass powder under the condition as in Table 1. The length of the thermal plasma was about 300 mm, and the plasma was in the form of a laminar flow. The quartz powder used herein had a mean particle size of 30 μm. The thermal spraying distance from the thermal spray gun was varied to be 90 mm, 120 mm and 140 mm. In that condition, three deposit layers (lower layer, middle layer, upper layer) were formed to be a thermal sprayed quartz glass film on the substrate.

Thus fabricated, the surface roughness Ra of the quartz glass thermal sprayed part was 35 μm; and the relative density of the quartz glass film was 80% in the upper part, 95% in the middle part and 100% in the lower part. The film had fine bubbles, but did not have any large pores of 100 μm or more. The mean inclination angle of the hillocks and recesses formed in the surface of the quartz glass film was 45°.

EXAMPLE 3

Plasma thermal spraying was effected in the same manner as in Example 2, in which, however, quartz powder having a mean particle size of 100 μm was used.

Thus fabricated, the surface roughness Ra of the quartz glass thermal sprayed part was 90 μm; and the relative density of the quartz glass film was 77% in the upper part, 92% in the middle part and 100% in the lower part. The film had fine bubbles, but did not have any large pores of 100 μm or more. The mean inclination angle of the hillocks and recesses formed in the surface of the quartz glass film was 40°.

EXAMPLE 4

Plasma thermal spraying was effected in the same manner as in Example 2, in which, however, quartz powder having a mean particle size of 20 μm was used.

Thus fabricated, the surface roughness Ra of the quartz glass thermal sprayed part was 10 μm; and the relative density of the quartz glass film was 75% in the upper part, 90% in the middle part and 100% in the lower part. The film had fine bubbles, but did not have any large pores of 100 μm or more. The mean inclination angle of the hillocks and recesses formed in the surface of the quartz glass film was 35°.

EXAMPLE 5

Using a plasma thermal spraying apparatus as in FIG. 4, a quartz glass film was formed on a stainless sheet substrate having a thickness of 2 mm and a square size of 100 mm×100 mm. The plasma thermal spraying condition is shown in Table 1. The plasma length was 60 mm. Thus formed, the quartz glass film has a relative density of 80% and a surface roughness Ra of 35 μm. No deformation (warping, cracking) was found in the quartz glass thermal sprayed part.

EXAMPLE 6

Using a plasma thermal spraying apparatus as in FIG. 4, a quartz glass film was formed on a mullite sheet substrate having a thickness of 5 mm and a square size of 100 mm×100 mm. The plasma thermal spraying condition is shown in Table 1. The plasma length was 60 mm.

Thus formed, the quartz glass film has a relative density of 88% and a surface roughness Ra of 30 μm. The quartz glass thermal sprayed part was neither cracked nor broken under stress.

COMPARATIVE EXAMPLE 2

Plasma thermal spraying was effected in the same manner as in Example 2, in which, however, quartz powder having a mean particle size of 200 μm was used.

Thus formed, the surface roughness Ra of the quartz glass film was 110 μm, overstepping the scope of the invention.

EXAMPLE 7

A quartz glass film was formed on a quartz glass substrate through thermal spraying under the condition as in Table 2. This was dipped in a mixture of nitric acid/hydrofluoric acid that had been prepared by mixing nitric acid (concentration 61%) and hydrofluoric acid (concentration 46%) in a ratio of 1/1, for 6 hours, 12 hours and 24 hours. Then, this was rinsed with ultra-pure water and then dried in a clean oven.

Figure 7:
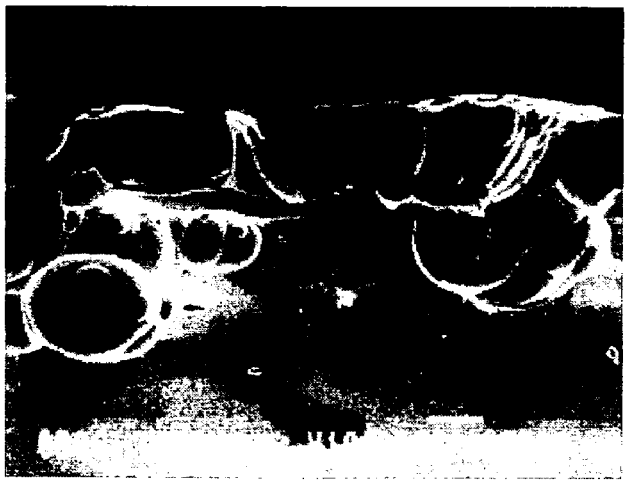
FIG. 7 is a cross-sectional SEM image of the sample obtained in Example 7 (by thermal spraying and then etching with hydrofluoric acid for 6 hours).
Figure 8:
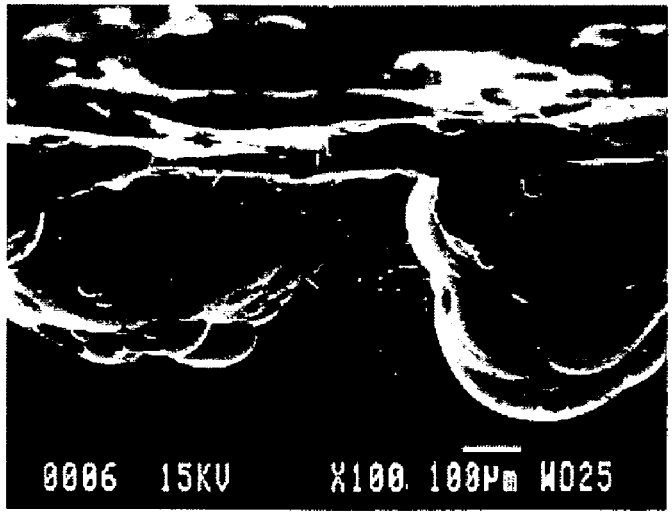
FIG. 8 is a cross-sectional SEM image of the sample obtained in Example 7 (by thermal spraying and then etching with hydrofluoric acid for 12 hours).
Figure 9:
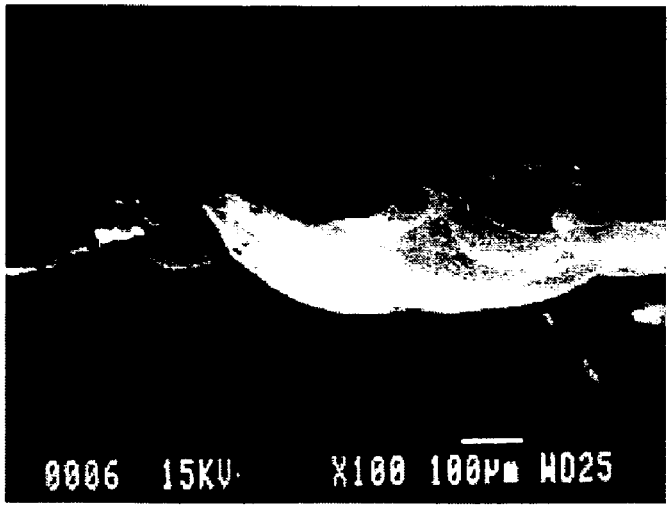
FIG. 9 is a cross-sectional SEM image of the sample obtained in Example 7 (by thermal spraying and then etching with hydrofluoric acid for 24 hours).

The surface roughness Ra of the thus-processed quartz glass film was 65 μm, 47 μm and 24 μm, respectively; and the mean inclination angle of the hillocks and recesses still remaining in the surface of the film was 36°, 27° and 25°, respectively. FIG. 7, FIG. 8 and FIG. 9 are cross-sectional SEM (scanning electro-microscopic) images of typical samples processed herein. As in these, dimples are formed in the recesses of the surface of each sample, and smaller dimples are further formed in those dimples. Even when the samples were dipped in the acid mixture until the quartz glass film almost dissolved away, the dimples were still as they were.

EXAMPLE 8

The thermal sprayed film formed in Example 3 was processed in the same manner as in Example 7.

The surface roughness Ra of the thus-processed quartz glass film was 180 μm, 120 μm and 80 μm, respectively; and the mean inclination angle of the hillocks and recesses still remaining in the surface of the film was 55°, 46° and 35°, respectively.

COMPARATIVE EXAMPLE 3

Figure 10:
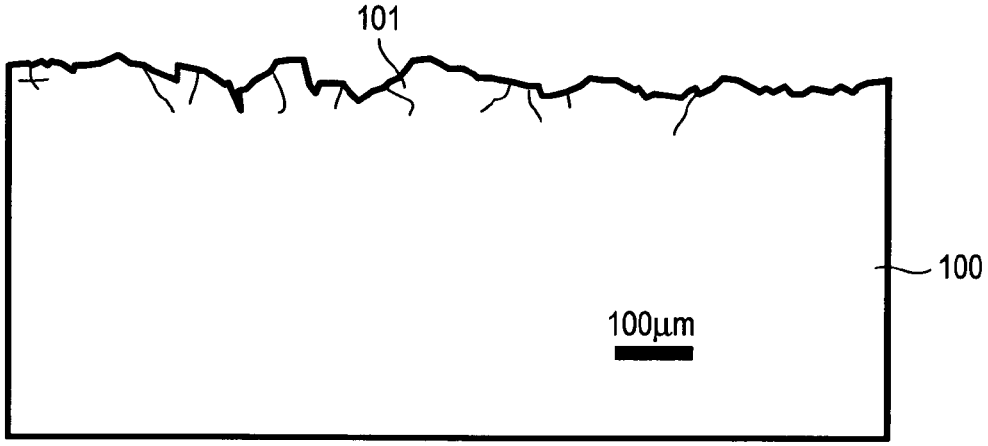
FIG. 10 is a graphical view showing the cross section of the blasted quartz glass part used in Comparative Example 3.

A polished quartz glass substrate was blasted with a grid of white alumina #60 under a pressure of 0.5 MPa, and-then dipped in an aqueous solution of 20% nitric acid and 0.5% hydrofluoric acid for 1 hour. Thus processed, the quartz glass substrate had a surface roughness Ra of 4 μm (this is hereinafter referred to as a blasted quartz glass substrate as shown in FIG. 10). The substrate was rinsed with ultra-pure water and dried in a clean oven, like quartz glass thermal sprayed parts. Under the same condition as in Example 7, this substrate was dipped in the etchant of nitric acid/hydrofluoric acid.

Figure 11:
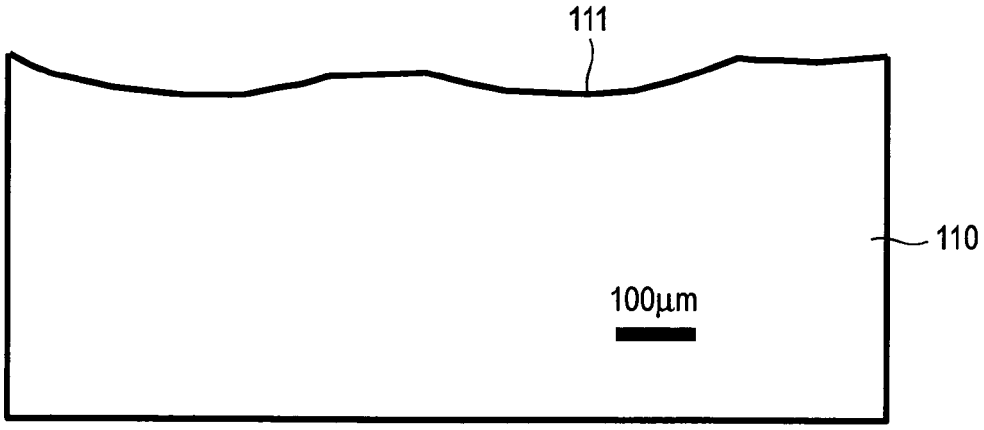
FIG. 11 is a graphical view showing the cross section of the quartz glass part etched with an acid, obtained in Comparative Example 3.

Thus etched, the surface of the substrate had large and gently-sloping dimples, and, different from those in Examples 7 and 8, no small dimple was formed in the large dimples. FIG. 11 is a graphical view showing the cross section of the sample processed herein. The mean inclination angle of the hillocks and recesses formed in the surface of the substrate was 19°, 15° and 11°, respectively.

EXAMPLE 9

Using a multi-torch plasma thermal spraying apparatus as in FIG. 5, a transparent quartz glass film was formed on a transparent quart glass substrate of natural rock crystal having a thickness of 6 mm and a square size of 50 mm×50 mm. The plasma thermal spraying condition is shown in Table 2.

Two types of spraying materials were tried. One was prepared by hydrolyzing high-purity silicon tetrachloride with oxyhydrogen flames followed by grinding and sieving the resulting synthetic quartz glass; and the other was prepared by grinding and sieving natural rock crystal. Before use, the two were dipped in 10% hydrofluoric acid for 3 hours, then rinsed with ultra-pure water and dried.

Immediately after plasma thermal sprayed, the coated substrates were exposed once to plasma jets alone with no spraying powder applied thereto, whereby the surface of the thermal sprayed film was melted. The process gave transparent quartz glass thermal sprayed parts of which the surfaces were smooth.

Before and after the exposure to plasma jets alone with no spraying powder, the surface roughness of the quartz glass film was 8 μm and 2 μm, respectively.

Thus fabricated, the quartz glass thermal sprayed parts were washed with 5% hydrofluoric acid and ultra-pure water and dried, and then both the quartz glass film-coated side and the substrate side of each part were etched with hydrofluoric acid and analyzed through ICP-mass spectrometry. The substrate side contained 8.0 ppm of Al, 0.8 ppm of Na, 0.6 ppm of K and 0.1 ppm of Cu. The quartz glass film formed of the synthetic quartz glass material contained 0.01 ppm of Al, 0.01 ppm of Na, 0.01 ppm of K and 0.01 ppm of Cu, and its purity was higher than 99.9999%. This means that the surface of the quartz glass film was not contaminated with impurities from the substrate. On the other hand, the quartz glass film formed of the natural quartz powder contained 9 ppm of Al, 0.7 ppm of Na, 0.5 ppm of K and 0.1 ppm of Cu, and was not contaminated with impurities from the substrate.

EXAMPLE 10

Using a multi-torch plasma thermal spraying apparatus as in FIG. 5, a quartz glass film was formed on an opaque quartz glass disc substrate (formed of Tosoh Quartz's OP-3 glass) having a diameter of 300 mmϕ and a thickness of 2 mm. The plasma thermal spraying condition is shown in Table 2. In this process, a laminar flow of plasma having a length of about 300 mm was formed.

The thermal spraying quartz powder was prepared by grinding and sieving natural quartz glass, then dipping it in 10% hydrofluoric acid for 1 hour, rinsing it with pure water and drying it.

Both surfaces of the opaque quartz glass disc substrate were thermally sprayed under the same condition to have a transparent quartz glass film having a thickness of 1 mm, and they were smoothed.

Thus fabricated, the surface roughness of the quartz glass films formed on the two surfaces of the quartz glass thermal sprayed part was 3.5 μm and 4.0 μm. Before processed with plasma jets for surface smoothening, the surface roughness Ra of the sprayed films was 12 μm.

The quartz glass thermal sprayed part and the original substrate not coated with the quartz glass film were both dipped in 25% hydrofluoric acid for 5 hours, and their surfaces were observed. Even after dipped in the acid, the surface of the quartz glass-sprayed part was still smooth. However, after dipped in the acid, the surface of the non-coated substrate was much roughened and lost surface smoothness, as the inner bubbles were exposed outside the surface.

EXAMPLE 11

In the same manner as in Example 9, a sprayed, transparent quartz glass film was formed on a black quartz glass substrate having a thickness of 6 mm and a square size of 50 mm×50 mm. Its surface roughness was 2 μm.

Thus fabricated, the quartz glass-sprayed parts were washed with 5% hydrofluoric acid and ultra-pure water and dried, and then both the quartz glass film-coated side and the substrate side of each part were etched with hydrofluoric acid and analyzed through ICP-mass spectrometry. The substrate side contained 35 ppm of Al, 0.8 ppm of Na, 0.6 ppm of K and 3.0 ppm of Cu. The quartz glass film formed of the synthetic quartz glass material contained 0.01 ppm of Al, 0.01 ppm of Na, 0.01 ppm of K and 0.01 ppm of Cu; and the quartz glass film formed of the natural quartz powder contained 9 ppm of Al, 0.7 ppm of Na, 0.5 ppm of K and 0.1 ppm of Cu. These sprayed films were not contaminated with impurities from the black quartz glass substrate.

EXAMPLE 12

Using a multi-torch plasma thermal apparatus as in FIG. 5, a quartz glass film was formed on a transparent quartz glass disc substrate having a diameter of 300 mmϕ and a thickness of 1.5 mm. The plasma thermal spraying condition is shown in Table 2. In this process, a laminar flow of plasma having a length of about 300 mm was formed.

The spraying quartz powder was prepared by grinding and sieving natural quartz glass, then dipping it in 10% hydrofluoric acid for 1 hour, rinsing it with pure water and drying it.

Under the condition shown in Table 2, an opaque quartz glass film having a porosity of 20% and a thickness of 2 mm was first formed on the substrate at a spray gun moving speed of 200 m/sec; then a dense film having a lower porosity was formed on it at a spray gun moving speed of 100 mm/sec; and finally this was exposed to plasma jets alone at a gun speed of 80 mm/sec with no spraying powder applied thereto. Thus formed, the quartz glass film had a smooth surface.

The surface roughness of the sprayed quartz glass film of the quartz glass-sprayed part was 2.5 μm. On the other hand, the surface roughness Ra of the sprayed quartz glass film of the quartz glass thermal sprayed part, which was fabricated in the same manner as herein but was not exposed to the final plasma jets, was 9 μm.

The quartz glass thermal sprayed part was dipped in 25% hydrofluoric acid for 5 hours, and it still kept its surface smoothness as such.

The quartz glass thermal sprayed part and the non-coated substrate were heated with a burner at their backs, and the temperature of their opposite faces was measured. The non-coated substrate took only 1 minute to make the thermocouple on its opposite face reach 300° C., but the quartz glass-sprayed part took 2 minutes for the same. This supports the increased heat resistance of the quartz glass thermal sprayed part.

EXAMPLE 13

Using a plasma thermal spraying apparatus as in FIG. 4, an opaque quartz glass film and a transparent quartz glass film were formed on a stainless sheet substrate having a thickness of 2 mm and a square size of 100 mm×100 mm. The plasma thermal spraying condition is shown in Table 2. The plasma length was 60 mm.

The thermal spraying quartz powder was prepared by hydrolyzing high-purity silicon tetrachloride with oxyhydrogen flames followed by grinding and sieving the resulting synthetic quartz glass.

An opaque quartz glass film was first formed on the substrate at a spray distance of 50 mm and at a spray gun moving speed of 300 mm/sec; then a transparent quartz glass film was again formed on it at a spray distance of 40 mm and at a spray gun moving speed of 200 mm/sec; and finally, immediately after the last spraying, the entire surface of the thus-thermal sprayed film was exposed once to plasma jets alone in the same manner as previously but with no spraying powder applied thereto, and the surface smoothness of the thermal sprayed film was thereby improved. The coated substrate was turned over, and its opposite side was coated with a sprayed, opaque quartz glass film (lower side) and a sprayed, transparent quartz glass film (upper side) in the same manner as above.

Thus fabricated, the surface roughness of the sprayed quartz glass film of the quartz glass thermal sprayed part was 1.5 μm. No deformation (warping, cracking) was found in the quartz glass thermal sprayed part.

EXAMPLE 14

Using a plasma thermal spraying apparatus as in FIG. 4, a transparent quartz glass film was formed on a mullite sheet substrate having a thickness of 2 mm and a square size of 100 mm×100 mm. The plasma thermal spraying condition is shown in Table 2. The plasma jets formed herein had a length of 60 mm.

The spraying quartz powder was prepared by hydrolyzing high-purity silicon tetrachloride with oxyhydrogen flames followed by grinding and sieving the resulting synthetic quartz glass. An opaque quartz glass film having a porosity of 15% was first formed on the substrate at a spray distance of 55 mm and at a spray gun moving speed of 300 m/sec; then a dense film was formed on it at a spray distance of 40 mm and at a spray gun moving speed of 200 mm/sec; and finally this was exposed to plasma jets alone with no spraying powder applied thereto, and the surface of the thus-sprayed quartz glass film was thereby smoothed.

Thus formed, the surface roughness of the sprayed quartz glass film was 1.5 μm.

EXAMPLE 15

Using a multi-torch plasma thermal spraying apparatus as in FIG. 5, a quartz glass film was formed on a transparent quartz glass disc substrate having a diameter of 300 mmϕ and a thickness of 1.5 mm. The plasma thermal spraying condition is shown in Table 3.

The spraying quartz powder was prepared by grinding and sieving natural quartz glass, then dipping it in 10% hydrofluoric acid for 1 hour, rinsing it with pure water, drying it, and adding thereto 0.3% by weight of silicon nitride powder having a mean particle size of 1 μm followed by dry-mixing them in a quartz glass chamber.

Thus formed, the quartz glass film was opaque, having a porosity of 15% and a thickness of 2 mm, in which the bubbles had a mean particle size of 80 μm.

Next, a transparent quartz glass film having a thickness of 1.5 mm was formed on it in the same manner as previously, for which, however, the spraying powder did not contain silicon nitride powder. Finally, this was exposed to plasma jets alone with no spraying powder applied thereto, and the surface of the thus-sprayed quartz glass film was thereby smoothed.

Thus fabricated, the surface roughness Ra of the quartz glass thermal sprayed part was 3 μm.

The quartz glass thermal sprayed part was dipped in 25% hydrofluoric acid for 5 hours, and it still kept its surface smoothness as such. The quartz glass thermal sprayed part and the non-coated substrate were heated with a burner at their backs, and the temperature of their opposite faces was measured with a thermocouple kept in contact with the faces. The non-coated substrate took only 1 minute to make the thermocouple on its opposite face reach 300° C., but the quartz glass-sprayed part took 2 minutes for the same. This supports the increased heat resistance of the quartz glass-sprayed part.

EXAMPLE 16

Using a multi-torch plasma thermal spraying apparatus as shown in FIG. 5, a black quartz glass film was formed on a transparent quartz glass substrate having a width of 40 mm, a length of 600 mm and a thickness of 2 mm. The plasma thermal spraying condition is shown in Table 3. The plasma jets formed a laminar flow having a length of 300 mm.

The spraying quartz powder was prepared by grinding and sieving black quartz glass with 0.8 wt. % Nb, then dipping it in 10% hydrofluoric acid for 1 hour, rinsing it with pure water and drying it.

On the surface of the thus-thermal sprayed film, there existed some particles not firmly adhering to the film. To remove them, the entire surface of the film was exposed once to plasma jets alone with no thermal spraying powder applied thereto, whereby the particulate deposit was melted and remove.

Thus fabricated, the black quartz glass thermal sprayed part was entirely black with no mottled color, and its light transmittance was at most 0.5% at any wavelength falling within a wavelength range of from 185 to 25000 nm. Through its X-ray diffraction, no crystalline substance was found. This confirms the vitrification of the thermal sprayed film.

EXAMPLE 17

Using a multi-torch plasma thermal spraying apparatus as shown in FIG. 5, a black quartz glass film was formed on a transparent quartz glass substrate having a width of 150 mm, a length of 200 mm and a thickness of 4 mm. The plasma thermal spraying condition is shown in Table 3.

The thermal spraying quartz powder was prepared by grinding and sieving black quartz glass with 3 wt. % V, then dipping it in 10% hydrofluoric acid for 1 hour, rinsing it with pure water and drying it.

After the black quartz glass film was formed, high-purity rock crystal powder having a mean particle size of 40 μm was sprayed on it in the same manner as previously, and then this was exposed to plasma jets alone with no thermal spraying powder applied thereto. Thus processed, a transparent quartz glass film having a smooth surface was formed on the black quartz glass film.

The black quartz glass thermal sprayed part thus fabricated herein was entirely black with no mottled color, and its light transmittance was almost negligible at any wavelength falling within a wavelength range of from 185 to 25000 nm. Its X-ray diffraction confirmed that both the black film and the transparent film were vitreous.

EXAMPLE 18

A half of the outer periphery of a transparent quarts glass tube having an outer diameter of 20 mm, a thickness of 1 mm and a length of 550 mm was masked with a half-cut quartz tube having an inner diameter of 20 mm. Using a multi-torch plasma thermal spraying apparatus, a black quartz glass film was formed on the thus-masked quartz tube. The spraying condition is shown in Table 3.

Specifically, only the part of the substrate not masked with the half-cut quartz tube was processed under the condition shown in Table 3 to form a thermal sprayed film thereon. The thermal spraying powder was prepared by grinding and sieving black quartz glass with 5 wt. % Mo, then dipping it in 10% hydrofluoric acid for 1 hour, rinsing it with pure water and drying it.

Next, the half-cut quartz glass tube mask was removed from the thus-processed substrate, and the black quartz glass thermal sprayed part of the substrate was masked with the same mask. Then, this was sprayed with high-purity rock crystal powder having a mean particle size of 40 μm in the same manner as previously in forming the black quartz glass film, and a transparent quartz glass film having a thickness of 1 mm was thus formed on it.

Finally, the mask was removed, and it was entirely exposed to plasma jets alone with no spraying powder applied thereto. Thus processed, the quartz glass tube had a black quartz glass film-sprayed part and a transparent quartz glass film-spray coated part with no step difference between the two parts.

EXAMPLE 19

Using a multi-torch plasma thermal spraying apparatus as shown in FIG. 5, a black quartz glass film was formed on an opaque quartz glass disc substrate (formed of Tosoh Quartz's OP-3 glass) having a diameter of 250 mmϕ and a thickness of 2 mm. The plasma thermal spraying condition is shown in Table 3.

The thermal spraying quartz powder was prepared by grinding and sieving black quartz glass with 3 wt. % C, then dipping it in 10% hydrofluoric acid for 1 hour, rinsing it with pure water and drying it.

Next, high-purity rock crystal powder was sprayed on it to form a transparent quartz glass film thereon. The plasma gas used was argon gas with 10% hydrogen gas. Finally, this was exposed to plasma jets alone with no spraying powder applied thereto.

Thus fabricated, the quartz glass part had a thermal sprayed, black quartz glass layer formed on the opaque quartz glass substrate having a smooth surface and a porosity of 30%, further having a sprayed, colorless transparent quartz glass film formed on that black layer.

EXAMPLE 20

This is to test the quartz glass thermal sprayed part of which the surface roughness Ra is over 100 μm (Comparative Example 2), the blasted quartz glass substrate etched with hydrofluoric acid (Comparative Example 3), and quartz glass thermal sprayed parts of Examples 1, 7 and 8 for the ability to hold a deposit thereon. A silicon nitride film is formed through sputtering on them, and they are heated.

Specifically, a deposit film of silicon nitride was formed through sputtering on each substrate and each part under the condition mentioned below. The sputtering chamber was degassed to an ultimate vacuum of $5\times10^{-5}$ Pa, and a silicon target was sputtered toward the substrate or part to form thereon a silicon nitride film of 50 μm thick at room temperature. The sputtering gas was a mixture of argon and nitrogen, and its pressure was 0.2 Pa. After thus coated, each sample was inspected with a microscope. The deposit film slightly peeled off on the blasted quartz glass substrate and on the quartz glass thermal sprayed part of Comparative Example 2 of which the surface roughness of the thermal sprayed film is outside the scope of the invention; but it did not peel off at all on the quartz glass thermal sprayed parts of the Examples of the invention. Next, these samples were heated in nitrogen at 700° C. The silicon nitride film did not peel off at all on the quartz glass thermal sprayed parts of Examples 1, 7 and 8, but it almost completely peeled off on the substrate of Comparative Example 2 and on and part of Comparative Example 3.

The next is to demonstrate the deposit film-holding capability of the samples in a simulated system of cleaning semiconductor parts through reverse sputtering. In this, a mixed film of silicon dioxide and silicon was formed through sputtering on the samples, for simulated deposition on semiconductor parts in reverse sputtering. The film-depositing condition was the same as above, except that the sputtering pressure was changed to 0.3 Pa and two targets of silicon oxide and silicon were used. A mixed film of silicon dioxide (thickness 80%) and silicon (thickness 20%) was formed, and its thickness was 30 μm.

After the film was formed thereon, the samples were left in air for 1 day, and observed with a microscope. More than half of the film peeled off on the samples of Comparative Examples 2 and 3, but the film did not almost peel off on the quartz glass-sprayed parts of the Examples of the invention.

COMPARATIVE EXAMPLE 4

A transparent quartz glass substrate formed of natural rock crystal and having a thickness of 6 mm and a square size of 50 mm×50 mm was coated with high-purity quartz glass according to the Verneuil's method under the condition mentioned below. The substrate was set in a firebrick furnace, with a burner of oxyhydrogen flames spaced from it by 100 mm. Oxygen of 80 SLM and hydrogen of 160 SLM were applied to the burner, and the substrate was thereby heated at 1900° C. while rotated at a speed of 10 mm/sec. Next, quartz glass powder was applied to the substrate at a rate of 10 g/min, and a transparent quartz glass layer was thereby formed on the substrate still being rotated at 10 mm/sec while spaced from the oxyhydrogen burner by 100 mm. The quartz glass powder was prepared by hydrolyzing high-purity silicon tetrachloride with oxyhydrogen flames, then grinding the resulting synthetic quartz and sieving it to collect particles having a particle size of from 100 μm to 250 μm. Before use, it was dipped in 10% hydrofluoric acid for 3 hours, then rinsed with ultra-pure water and dried.

The transparent quartz glass layer having a thickness of 1 mm was thus formed on the substrate, and this was washed with 5% hydrofluoric acid, then rinsed with ultra-pure water and dried. A 10 μm-thick piece was sampled from the transparent quartz glass layer and from the substrate. They were separately dissolved in hydrofluoric acid and analyzed through ICP-mass spectrometry. The substrate contained 8 ppm of Al, 0.8 ppm of Na, 0.6 ppm of K and 0.1 ppm of Cu; while the quartz glass layer formed on the substrate contained 1 ppm of Al, 0.2 ppm of Na, 0.1 ppm of K and 0.05 ppm of Cu. From the data, it is understood that, even though synthetic quartz glass prepared from through hydrolysis of high-purity silicon tetrachloride was used in forming the coating layer, the amount of the impurities in the coating layer is large and many impurities diffused from the substrate into the coating layer.

COMPARATIVE EXAMPLE 5

A powder was prepared by grinding black quartz glass with 3 wt. % V followed by sieving it to collect particles having a particle size of from 30 μm to 65 μm, and this was pressed into a block. On the other hand, a laminate of the pressed block of black quartz glass and a pressed block of transparent quartz glass was prepared. These were separately heated and melted in a vacuum melting furnace to obtain a wholly black quartz glass mass, and a laminate quartz glass mass composed of transparent quartz glass and black quartz glass. These masses were cut and polished into quartz glass parts.

The black quartz glass parts fabricated in Examples 16 to 19, and the above-mentioned wholly black quartz glass part and laminate black/transparent quartz glass part were kept in an electric furnace in air at 1200° C. for 3 days. Through X-ray diffraction, no crystallization was found in the quartz glass parts of Examples 16 to 19.

On the other hand, the laminated quartz glass part fabricated in the vacuum melting furnace had some devitrified parts in the interface between the transparent quartz glass and the black quartz glass. The wholly black quartz glass part had some peppers that were formed through oxidation of the blackening compound added to it.

The advantages of the quartz glass-sprayed parts of the invention are mentioned below.

1) The parts of which the surface roughness Ra of the sprayed quartz glass film is 5 μm or more are good, as their ability to hold a deposit film thereon is good.

2) The parts have no microcrack, and the adhesiveness between the sprayed quartz glass film and the substrate is high. Therefore, the thermal sprayed film does not peel off to give particles.

3) Even when the parts are repeatedly washed with hydrofluoric acid, their ability to hold a deposit film thereon does not lower.

4) The parts of which the surface roughness Ra is smaller than 5 μm are good, as their ability to airtightly and firmly bond to other parts is still sufficient.

5) Even when metal or ceramics are used for the substrate, there is no diffusion of impurities from the substrate.

6) The parts coated with a quartz glass film which includes porous opaque quartz glass layers have a good ability of heat insulation.

7) The parts coated with a black quartz glass film also have a good ability of heat insulation.

8) Different from ordinary bulks formed from melted black quartz glass, the parts of the invention do not crystallize and deteriorate under heat.

TABLE 1

| No. Apparatus | Example 1 type of FIG. 4 | | Comp. Ex. 1 type of FIG. 4 | | Example 2 type of FIG. 5 | | Example 3 type of FIG. 5 | | Example 4 type of FIG. 5 | | Example 5 type of FIG. 4 | | Example 6 type of FIG. 4 | | Comp. Ex. 2 type of FIG. 4 | |
|---|---|---|---|---|---|---|---|---|---|---|---|---|---|---|---|---|
| Plasma gas (SLM*) | preheating | spraying | preheating | spraying | preheating | spraying | preheating | spraying | preheating | spraying | preheating | spraying | preheating | spraying | preheating | spraying |
| | $N_2$ 40 | ← | $N_2$ 40 | ← | $N_2$ 5 | ← | ng | ← | $N_2$ 5 | ← | $A_r$ 35 | ← | $A_r$ 35 | ← | $A_r$ 35 | ← |
| | $H_2$ 15 | ← | $H_2$ 15 | ← | | | $N_2$ 5 | | | | $H_2$ 15 | ← | $H_2$ 15 | ← | $H_2$ 15 | ← |
| Spray Distance (mm) | 50 | 50 | 120 | 120 | 100 | 90→120→140 | 100 | 90→120→140 | 100 | 90→120→140 | 40 | 40 | 50 | 40 | 50 | 40 |
| Gun Moving Speed (mm/s) | 30 | 30 | 30 | 30 | 80 | 80 | 80 | 80 | 80 | 80 | 200 | 100 | 200 | 100 | 200 | 100 |
| Power (kW) | 40 | 40 | 40 | 40 | 20 | 20 | 20 | 20 | 20 | 20 | 35 | 35 | 35 | 35 | 35 | 35 |
| Preheating Temp. (° C.) | | | | | 700 | | 700 | | 700 | | 700 | | 750 | | 750 | |
| Temperature after film formation (° C.) | | | | | | | | | | | | | | | | |
| Material of Substrate | quartz glass | | quartz glass | | quartz glass | | quartz glass | | quartz glass | | stainless | | mullite | | mullite | |
| Spraying Material Feed Rate (g/min) | | 15 | | 15 | | 8 | | 8 | | 8 | | 15 | | 15 | | 15 |
| | | ① 15 | | 40 | | 30 | | 100 | | 20 | | 30 | | 30 | | 200 |
| | | ② 30 | | | | | | | | | | | | | | |
| Mean particle size (μm) | | ③ 50 | | | | | | | | | | | | | | |
| | | ④ 80 | | | | | | | | | | | | | | |
| Film Thickness (mm) | | 0.2 | | — | | 0.6 | | 0.6 | | 0.6 | | 0.5 | | 0.4 | | 0.4 |
| Treatment after formation of sprayed film | $HNO_2$ 20% HF 0.5% 1 | | | | HF 5% 0.5 | | HF 5% 0.5 | | HF 5% 0.5 | | HF 5% 0.5 | | HF 5% 0.5 | | HF 5% 0.5 | |
| Processing Time (hr) | | | | | | | | | | | | | | | | |
| Surface Roughness Ra (μm) | | ① 12 | | | | 35 | | 90 | | 10 | | 35 | | 30 | | 110 |
| | | ② 23 | | | | | | | | | | | | | | |
| | | ③ 35 | | | | | | | | | | | | | | |
| | | ④ 46 | | | | | | | | | | | | | | |
| Relative Density (%) | | ① 88 | | | | 80/95/100 | | 77/92/100 | | 75/90/100 | | 80 | | 88 | | |
| | | ② 78 | | | | | | | | | | | | | | |
| | | ③ 70 | | | | | | | | | | | | | | |
| | | ④ 65 | | | | | | | | | | | | | | |
| Remarks | FIG. 6 | | Film not formed | | Density gradient | | Density gradient | | Density gradient | | Stainless substrate | | Mullite substrate | | | |

*Standard Liter per Minute

TABLE 2

| No. Apparatus | Example 7 Type of FIG. 5 | | Comp. Ex. 3 not sprayed | Example 8 Type of FIG. 5 | | Example 9 Type of FIG. 5 | | Example 10 Type of FIG. 5 | | Example 11 Type of FIG. 5 | | Example 12 Type of FIG. 5 | | Example 13 Type of FIG. 4 | | Example 14 Type of FIG. 4 | | Example 15 Type of FIG. 5 | |
|---|---|---|---|---|---|---|---|---|---|---|---|---|---|---|---|---|---|---|---|
| Plasma gas (SLM*) | preheating $N_2$ 5 | spraying ← | | preheating $N_2$ 5 | spraying ← | preheating $A_r$ 10 | spraying ← | preheating $A_r$ 10 | spraying ← | preheating $A_r$ 10 | spraying ← | preheating $A_r$ 10 | spraying ← | preheating $A_r$ 35 $H_2$ 15 | spraying ← ← | preheating $A_r$ 35 $H_2$ 15 | spraying ← ← | preheating $A_r$ 10 | spraying ← |
| Spray Distance (mm) | 100 | 100 | | 100 | 90→120→140 | 100 | 100 | 80 | 80 | 100 | 100 | 80 | 80 | 40 | 50→40→40 | 50 | 55→40→40 | 80 | 80 |
| Gun Moving Speed (mm/s) | 80 | 80 | | 80 | 80 | 100 | 100 | 130 | 130 | 100 | 100 | 130 | 200→100→80 | 200 | 300→200→200 | 200 | 300→200→200 | 130 | 130 |
| Power (kW) | 20 | 20 | | 20 | 20 | 25 | 25 | 25 | 25 | 25 | 25 | 25 | 25 | 35 | 35 | 35 | 35 | 25 | 25 |
| Preheating Temp. (° C.) | 800 | | | 700 | | 900 | | 800 | | 900 | | 800 | | 700 | | 700 | | 800 | |
| Temperature after film formation (° C.) | | | | | | | 1000 | | 950 | | 1000 | | 950 | | 650~750 | | 650~750 | | 750→950 |
| Material of Substrate | quartz glass | | | quartz glass | | quartz glass | | opaque quartz glass | | black quartz glass | | quartz glass | | stainless | | mullite | | transparent quartz disc | |
| Spraying Material Feed Rate (g/min) | | 8 30 | | | 8 100 | | 10 30–65 | | 10 30–65 | | 10 30–65 | | 10 30–65 | | 20 30–65 | | 20 30–65 | | 10 30–65 with SiN |
| Mean particle size(μm) | | | | | | | | | | | | | | | | | | | |
| Film Thickness (mm) | | 0.6 | | | 0.6 | | 1 | | 1 | | 1 | | 3.5 (2/1.5) | | 0.7 (0.3/0.4) | | 0.7 (0.3/0.4) | | 3.5 (2/1.5) |
| Treatment after formation of sprayed film | $HNO_2$ 61% HF 46% ① 6② 12③ 24 | | HF 5% 0.5 | $HNO_2$ 61% HF 46% ① 6② 12③ 24 | | HF 5% 0.5 | | HF 5% 0.5 | | HF 5% 0.5 | | HF 5% 0.5 | | HF 5% 0.5 | | HF 5% 0.5 | | HF 5% 0.5 | |
| Processing Time (hr) | | | | | | | | | | | | | | | | | | | |
| Surface Roughness Ra (μm) | | ① 65 ② 47 ③ 24 | 10 | | ① 180 ② 120 ③ 80 | | 2 | | 3.5–4 | | 2 | | 2.5 | | 1.5 | | 1.5 | | 3 |
| Relative Density (%) | | | | | 77/92/100 | | | | | | | | | | | | | | |
| Remarks | spraying + acid etching FIGS. 7, 8, 9 | | blasting + acid etching FIGS. 10, 11 | spraying + acid etching | | surface smoothing | | surface smoothing | | surface smoothing | | surface smoothing opaque quartz laminated | | surface smoothing opaque quartz laminated stainless substrate | | surface smoothing opaque quartz laminated mullite substrate | | surface smoothing opaque quartz laminated faming agent (SiN) used | |

*: Standard Liter per Minute

TABLE 3

| No.<br>Apparatus | Example 16<br>type of FIG. 5 | | Example 17<br>type of FIG. 5 | | Example 18<br>type of FIG. 5 | | Example 19<br>type of FIG. 5 | |
|---|---|---|---|---|---|---|---|---|
| Plasma gas (SLM*) | Preheating<br>$A_r$ 10 | spraying<br>$A_r$ 9<br>$H_2$ 1 | preheating<br>$A_r$ 10 | spraying<br>$A_r$ 9<br>$H_2$ 1 | preheating<br>$A_r$ 10 | spraying<br>$A_r$ 9<br>$H_2$ 1 | preheating<br>$A_r$ 10 | spraying<br>$A_r$ 9<br>$CH_1$ 1 |
| Spray Distance (mm) | 100 | 100 | 100 | 100 | 100 | 100 | 100 | 100 |
| Gun Moving Speed (mm/s) | 100 | 100 | 100 | 100 | 100 | 100 | 120 | 120 |
| Power (kW) | 23 | 23 | 23 | 23 | 23 | 23 | 25 | 25 |
| Preheating Temp. (° C.) | 900 | | 900 | | 900 | | 850 | |
| Temperature after film formation (° C.) | | 1000 | | 1050 | | 1050 | | 1000 |
| Material of Substrate | quartz glass | | quartz glass | | quartz glass tube | | opaque quartz glass | |
| Spraying | | 10 | | 10 | | 10 | | 10 |
| Material Feed Rate (g/min) | | 30~65 | | 30~65→40 | | 30~65/40 | | 30~65/40 |
| Mean particle size (μm) | | black Nb 0.8% | | black V 3 % →rock crystal | | black Mo 3% →rock crystal | | black C 3 % →rock crystal |
| Film Thickness (mm) | | 1 | | 2.4 (black 1.4/transparent 1) | | 2.4 (black 1.4/transparent 1) | | 2.4 (black 1.4/transparent 1) |
| Treatment after formation of sprayed film | HF 5% | | HF 5% | | HF 5% | | HF 5% | |
| Processing Time (hr) | 0.5 | | 0.5 | | 0.5 | | 0.5 | |
| Surface Roughness Ra (μm) | | | | | | | | |
| Relative Density (%) | | | | | | | | |
| Remarks | black quartz | | black quartz + transparent quartz laminated | | black quartz + transparent quartz laminated | | opaque/black/transparent quart laminated | |

*: Standard Liter per Minute

What is claimed is:

1. A quartz glass thermal sprayed part comprising a substrate and a quartz glass thermal sprayed film having a surface roughness Ra of from 5 to 100 μm formed on a surface of the substrate, and having rounded hillocks and steep V-shaped valleys between the hillocks.

2. The quartz glass thermal sprayed part as claimed in claim 1, wherein the substrate is quartz glass, metal or ceramics.

3. A quartz glass thermal sprayed part comprising a substrate, a porous opaque quartz glass thermal sprayed film, and a quartz glass thermal sprayed film having a surface roughness Ra of from 0.001 μm to smaller than 5 μm, in this order.

4. The quartz glass-sprayed part as claimed in claim 3, wherein the substrate is quartz glass, metal or ceramics.

5. The quartz glass thermal sprayed part as claimed in claim 1, wherein the quartz glass thermal sprayed film has a mean inclination angle of the hillocks and recesses of from 20 to less than 60°.

* * * * *